US005363764A

United States Patent [19]

Horiguchi et al.

[11] Patent Number: 5,363,764

[45] Date of Patent: Nov. 15, 1994

[54] PRINTING PLATE MOUNTING APPARATUS, PRINTING PLATE REPLACEMENT APPARATUS AND PRINTING PLATE REPLACEMENT METHOD

[75] Inventors: Takeshi Horiguchi; Torao Katabira, both of Zama, Japan

[73] Assignee: Toshiba Kikai Kabushiki Kaisha, Tokyo, Japan

[21] Appl. No.: 123,892

[22] Filed: Sep. 20, 1993

Related U.S. Application Data

[62] Division of Ser. No. 11,248, Jan. 29, 1993, Pat. No. 5,272,977.

[30] Foreign Application Priority Data

Feb. 5, 1992 [JP] Japan ..... 4-3967
Mar. 9, 1992 [JP] Japan ..... 450966

[51] Int. Cl.[5] ..... B41F 27/00

[52] U.S. Cl. ..... 101/485; 101/477; 101/415.1; 101/DIG. 36

[58] Field of Search ..... 101/485, 477, 415.1, 101/378, 382.1, 383, DIG. 36

[56] References Cited

U.S. PATENT DOCUMENTS

| | | | |
|---|---|---|---|
| 1,658,033 | 2/1928 | Bell | 101/378 |
| 1,876,378 | 9/1932 | Wilkinson | 101/378 |
| 3,195,457 | 7/1965 | Luehrs | 101/378 |
| 3,202,097 | 8/1965 | Doyle et al. | 101/378 |
| 3,237,557 | 3/1966 | Worthington et al. | 101/378 |
| 3,941,055 | 3/1976 | Semmler et al. | 101/378 |
| 5,094,165 | 3/1992 | Sugiyama et al. | 101/415.1 |
| 5,127,328 | 7/1992 | Wieland | 101/415.1 |
| 5,167,186 | 12/1992 | Honkawa et al. | 101/477 |
| 5,218,907 | 6/1993 | Komori et al. | 101/415.1 |
| 5,259,314 | 11/1993 | Sugiyama | 101/477 |

FOREIGN PATENT DOCUMENTS

| | | |
|---|---|---|
| 437340 | 2/1992 | Japan . |
| 227339 | 3/1992 | Japan . |

*Primary Examiner*—Eugene H. Eickholt
*Attorney, Agent, or Firm*—Cushman, Darby & Cushman

[57] ABSTRACT

A printing plate mounting apparatus is disclosed, which comprises a de-mounting and a mounting lever provided on an end of a lock shaft provided in a printing cylinder and printing plate replacement drive means including air cylinders or the like. With the printing cylinder held at a predetermined position, the drive means pushes each lever to rotate the lock shaft. In this way, the rotational driving of the lock shaft and coupling and de-coupling of the driving are effected collectively. A printing plate replacement apparatus is also disclosed, which comprises roller drive means including a roller and a cylinder or the like. When mounting a printing plate, the roller is urged against the printing cylinder via the printing plate. Otherwise, the roller is retreated by the roller drive means.

12 Claims, 27 Drawing Sheets

PRINTING PLATE MOUNTING APPARATUS, PRINTING PLATE REPLACEMENT APPARATUS AND PRINTING PLATE REPLACEMENT METHOD

This application is a divisional of Ser. No. 08/011,248, filed Jan. 29, 1993, now U.S. Pat. No. 5,272,977.

BACKGROUND OF THE INVENTION

1. Field of the Invention

This invention relates to a printing plate mounting apparatus, a printing plate replacement apparatus and a printing plate replacement method and can be utilized as a mechanism for mounting a sheet-like printing plate on a printing cylinder of a rotary printing press.

2. Description of the Related Art

Heretofore, in a rotary printing press ink is applied to a sheet-like printing plate mounted on a cylindrical printing press, and the printing cylinder is rotated to transfer ink from the printing plate to paper or the like and thus effect the printing.

For mounting such printing plate, a printing plate mounting mechanism is used, which winds a printing plate on the printing cylinder and take in and lock the ends of the printing plate with a lock shaft provided in the printing cylinder.

FIGS. 24 to 26 shows such a printing plate mounting mechanism 90. The mechanism comprises a lock shaft 93, which is provided in a cavity 92 formed axially in a printing cylinder 91 adjacent the surface thereof. The lock shaft 93 has an axially continuous slit 94, and an end of the printing plate 95 can be inserted in the slit 94 to be secured in the same.

The lock shaft 93 has an end portion projecting from an end face of the printing cylinder 91. A rotary block 81 is secured to the end portion. The rotary block 81 is secured in position by two pins 82 and 83 provided on the end face of the printing cylinder 91.

A counterpart block 84 is secured to the end face of the printing cylinder 91 at a position spaced apart from the rotary block 81. Between the counterpart block 84 and rotary block 81 is provided a compression coil spring 86, which is guided by a guide rod 85.

The components 81, 84, 85 and 86 constitute a toggle mechanism 80, which can hold the lock shaft 93 stably at two positions as shown in FIGS. 25 and 26.

When mounting the printing plate 95, the leading end of the printing plate 95 is inserted into the gap or clearance between the surface of the cavity 92 and the lock shaft 93 as shown at A in FIG. 25, the succeeding portion of the plate is wound on the printing cylinder 91 as shown at B, and the trailing end of the plate is inserted in the slit 94 as shown at C.

Then, the lock shaft 93 is rotated to take in the trailing end of the printing plate 95 inserted in the slit 94 while also taking in the leading end of the plate 95 in contact with the leading end as shown at D. Thus, the printing plate 95 is mounted in close contact with the surface of the printing cylinder 91 by tension from its opposite ends.

In such printing plate mounting mechanism 90, the lock shaft 93 is usually turned manually using a spanner or the like fitted on a hexagon nut (see FIG. 24) provided at the end of the lock shaft 93.

Meanwhile, recently there is an increasing demand for energy saving and automation, and it has been proposed to drive the lock shaft mechanically with a gear mechanism as shown in, for instance, Japanese Utility Model Laid-Open No. 27339/1990.

FIG. 27 shows such a printing plate mounting mechanism. This mechanism comprises a lock shaft 72 provided rotatably adjacent the surface of a printing cylinder 71. A small gear 71 is secured to an end of the lock shaft 72, and it is Meshed with a large gear 74. The large gear 74 is integral with an intermediate gear 75 and secured coaxially to an end of the printing cylinder 71. A rack 76 is meshed with the intermediate gear 75 in the tangential direction thereof.

The rack 76 is supported by a longitudinal drive cylinder 77 and also by an orthogonal drive cylinder 78. When the rack 76 is in its meshed state, it is advanced and retreated by the longitudinal drive cylinder 77 to rotate the lock shaft 722 via the intermediate gear 75, large gear 74 and small gear 73. For printing, it is demeshed from the intermediate,gear 75 by the cylinder 78 so that it will not interfere with the rotation of the printing cylinder 71.

In such printing plate mounting mechanism 70, however, since the rack 76 for driving the lock shaft 72 is supported by the two cylinders 77 and 78, instability in structure and also in operation is inevitable, and demeshing during operation is likely.

Further, since the operation of meshing of the rack 76 and intermediate gear 75 is effected in the orthogonal direction to the rack tooth face, failure of smooth meshing is likely.

Further, for ensuring smooth meshing it is necessary to operate the two cylinders 77 and 78 in an interlocked relation to each other, thus dictating complicated control.

To solve the above problems, the applicant has proposed a printing plate mounting mechanism, in which de-meshably meshed gears are supported on a shaft such that they can be meshed and de-meshed by displacing one of them along the shaft (Japanese Utility Model Application No. 77338/90).

In such printing pate mounting mechanism, the meshing and de-meshing of the gears are made with axial displacement, and also the lock shaft is rotated at a fixed position with the rotation of the gears about the shaft thereof. Thus, each operation may be performed independently. The stability of the operation of rotating the lock shaft and also at the time of the meshing of the gears can be enhanced, and reliable operation can be ensured with simple operation.

However, with the above printing plate mounting mechanism of the gear type noted above, it is possible to completely eliminate mutual catching of the gears even though the gears are meshed with axial displacement as noted above, and possible defective operation at the time of meshing the gears is inevitable.

Further, the above gear type printing plate mounting mechanism requires a printing cylinder side gear, a drive gear meshed and de-meshed with and from this gear, drive means for driving the drive gear to cause rotation of the lock shaft and means for controlling the meshing and de-meshing of the drive gear. Therefore, the complication and size increase of the mechanism are inevitable. Further, the space between the printing cylinder and the outer wall is narrow, and it is difficult to secure a space for installing a large size printing plate mounting mechanism along the end face of the printing cylinder. In other words, the installation of the mechanism requires great modification of the pertinent portion of the printing press.

In a further aspect, in the prior art printing plate mounting mechanisms noted above, although the ends of a printing plate wound on the printing cylinder periphery can be clamped, the printing plate is wound manually on the printing cylinder. More specifically, for winding the printing plate on the printing cylinder, it is necessary to insert and engage the leading end of the printing plate in the lock shaft, then wind the plate around the printing cylinder periphery by turning the cylinder, for instance, then insert the trailing end of the plate in the lock shaft and then clamp the plate with the printing plate mounting mechanism. Heretofore, these cumbersome operations are all done manually. Therefore, it is difficult to improve the operational efficiency when replacing the printing plate. In addition, there is high possibility of erroneous mounting or like because the operations are carried out manually. That is, reliable operation is impossible.

In the printer, the replacement of the printing plate is not automated while the other parts are automated variously. This has been posing problems in the operational efficiency improvement of the whole printer.

An object of the invention is to provide a printing plate mounting apparatus, which may be simple in structure and small in size and permits high stability to be obtained in operation.

Another object of the invention is to provide an apparatus for and method of replacing printing plate, which permit reliable and efficient replacement of a printing plate.

SUMMARY OF THE INVENTION

According to the invention, there is provided a printing plate mounting apparatus, which comprises a lock shaft buried in and extending in the axial direction of a printing cylinder at a predetermined locality of the printing cylinder periphery, the lock shaft serving to lock the ends of the printing plate at its predetermined lock position and unlock the ends at its predetermined unlock position, and lock shaft drive means for moving the lock shaft to the lock position while the printing cylinder is at a predetermined mounting position and moving the lock shaft to the unlock position while the printing cylinder is at a predetermined de-mounting position, the lock shaft drive means including a mounting lever and a de-mounting lever, these levers being secured to an end of the lock shaft and projecting in circumferentially opposite directions of the printing cylinder on the opposite sides of the lock shaft, and printing plate replacement drive means for rotating the lock shaft in a locking direction in contact with the mounting lever when the printing cylinder is at the mounting position and rotating the lock shaft in an unlocking direction in contact with the de-mounting lever when the printing cylinder is at the de-mounting position.

Where the mounting and de-mounting positions are the same, the lock shaft drive means includes two air cylinders each having a push rod capable of being advanced and retreated with respect to the printing cylinder. One of these air cylinders is capable of being in contact with the mounting lever, while the other air cylinder is capable of being in contact with the de-mounting lever. If necessary, the mounting and de-mounting levers may be fittedly secured to the end of the lock shaft and retained by stoppers.

Where the mounting and de-mounting positions are different, the lock shaft drive means includes an air cylinder having a push rod capable of being advanced an retreated with respect to the printing cylinder, and a push blade is attached to the push rod. The push blade is capable of being in contact with both of the mounting and de-mounting levers. Alternatively, the lock shaft drive means includes a contact member, which is capable of being advanced and retreated with respect to the printing cylinder and, while the printing cylinder is at the de-mounting position, contacts the de-mounting lever to rotate the lock shaft to the unlock position, and a cam member, which is formed on an end of the contact member and, when the printing cylinder approaches the de-mounting position in its forward rotation, guides the mounting lever in a predetermined direction to rotate the lock shaft to the lock position.

With such printing plate mounting apparatus according to the invention, for de-mounting the printing plate, the printing cylinder with the printing plate mounted thereon is stopped at the de-mounting position, and in this state the contact member of de-mounting drive means is advanced to push the de-mounting lever so as to cause rotation of the lock shaft toward the unlock position. Thus, the lock of the ends of the printing plate by the lock shaft is released, and the printing plate is removed.

For mounting a printing plate, the printing cylinder is stopped at the mounting position. In this state the printing plate is mounted on the printing cylinder periphery, and its ends are engaged with the lock shaft. Then, the contact member of mounting drive means is advanced to push the mounting lever so as to cause rotation of the lock shaft. Thus, the ends of the printing plate are taken in and locked in the lock shaft, thus effecting the mounting of the printing plate.

It is to be understood that according to the invention the operation of rotating the lock shaft can be realized by operating the levers with the contact member advanced or retreated using the drive means. Particularly, the advancement and retreat of the contact member directly cause coupling and de-coupling between the printing cylinder and the drive means, and thus dispensing with bi-directional motion as in the prior art gear type printing plate mounting mechanism.

According to the invention, there is also provided a printing plate replacement apparatus, which comprises a lock shaft buried movably in a printing cylinder at a predetermined locality near the printing cylinder periphery, the lock shaft serving to lock the ends of a printing cylinder at its predetermined unlock position, lock shaft drive means for moving the lock shaft to the lock position while the printing cylinder is a predetermined mounting position and moving the lock shaft to the unlock position while the printing cylinder is at a predetermined de-mounting position, a roller capable of being urged against and rolling over the entirety of the periphery of the printing cylinder such as to pinch portions of the printing plate locked to the printing cylinder near ends of the printing plate while the printing cylinder is at the mounting position, and roller drive means for moving the roller from an urged position, at which the roller is urged against said printing cylinder, to a retreated position, at which a predetermined gap is formed between the roller and the printing cylinder. The lock shaft drive means may be that which is used in the printing plate mounting apparatus. The roller is provided in a safety bar, which is disposed along a rolling contact section between the printing cylinder and a different cylinder. The roller drive means may have such a structure as to move the roller and the safety bar in unison with each other and be able to be stopped at a position, at which the safety bar is held along the rolling contact section. The roller drive means includes an escapement cylinder and an approach cylinder, these cylinders being coupled to the roller. The escapement cylinder causes advancement and retreat of the roller between an approach position and an escapement position. The approach cylinder causes advancement and retreat of the roller between an urged position and an approach position. Alternatively, it may have a structure including a gear mechanism for causing advancement and retreat with respect to three positions, i.e., the urged position, approach position and escapement position.

With such structure according to the invention, for de-mounting a printing plate the printing cylinder with the printing plate mounted thereon is stopped at the de-mounting position, then the lock shaft is moved to the unlock position to unlock the ends of the printing plate, then the trailing end of the printing plate is pulled out to the outside, and in this state the printing plate is gradually pulled away from the printing cylinder periphery by rotating the printing cylinder in the direction opposite to the direction in the normal operation. Thereafter, the printing cylinder is stopped at the mounting position, and the leading plate end engaged in the printing cylinder is taken out.

For mounting a printing plate, the printing cylinder is stopped at the mounting position, and the leading end of the new printing plate is inserted in the printing cylinder and engaged in the vicinity of the lock shaft. Also, a plate portion near the leading end is pinched and urged against the printing cylinder periphery with the roller. In this state, the printing cylinder is rotated forward to wind the printing plate around the printing cylinder periphery. At this time, the printing cylinder may be rotated slowly.

After the trailing end of the printing plate has been engaged in the lock shaft of the printing cylinder, the lock shaft is moved to the lock position to lock the trailing end of the printing plate to the printing cylinder. Prior to subsequent normal operation, the roller is moved to the escapement position, at which a predetermined gap is formed with respect to the printing cylinder.

DETAILED DESCRIPTION OF THE PREFERRED EMBODIMENT(S)

Now, embodiments of the invention will be described with reference to the drawings.

Figure 1:
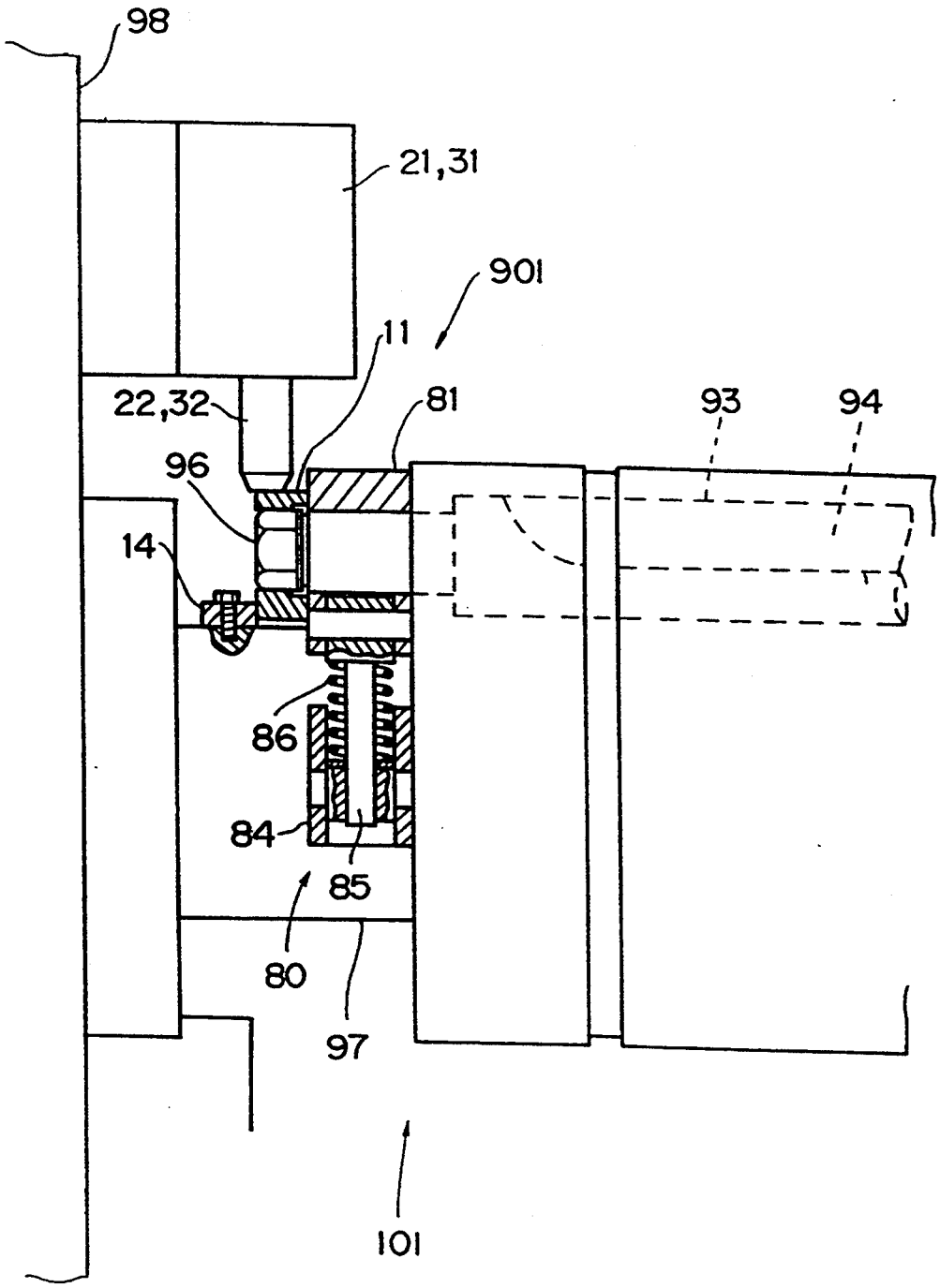
FIG. 1 is a partly sectional axial view showing an embodiment of the invention applied to the printing plate mounting apparatus.
Figure 2:
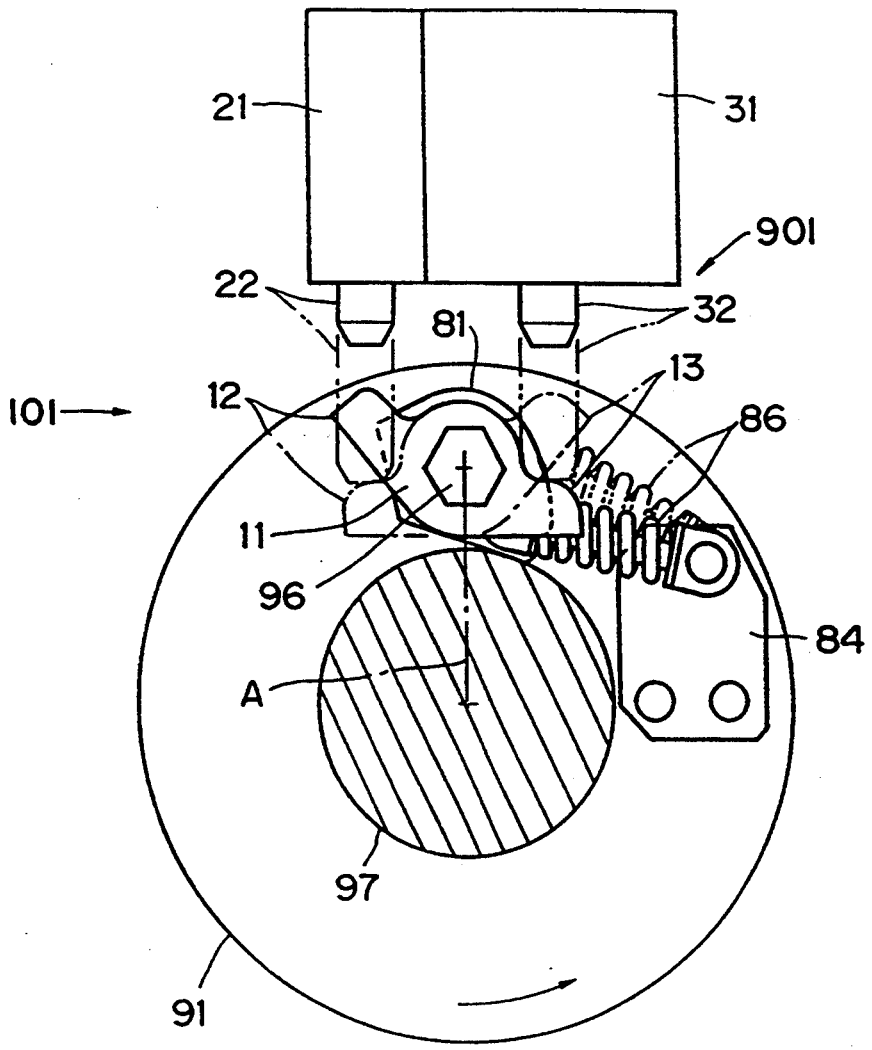
FIG. 2 is a transversal sectional view showing the same embodiment.
Figure 24:
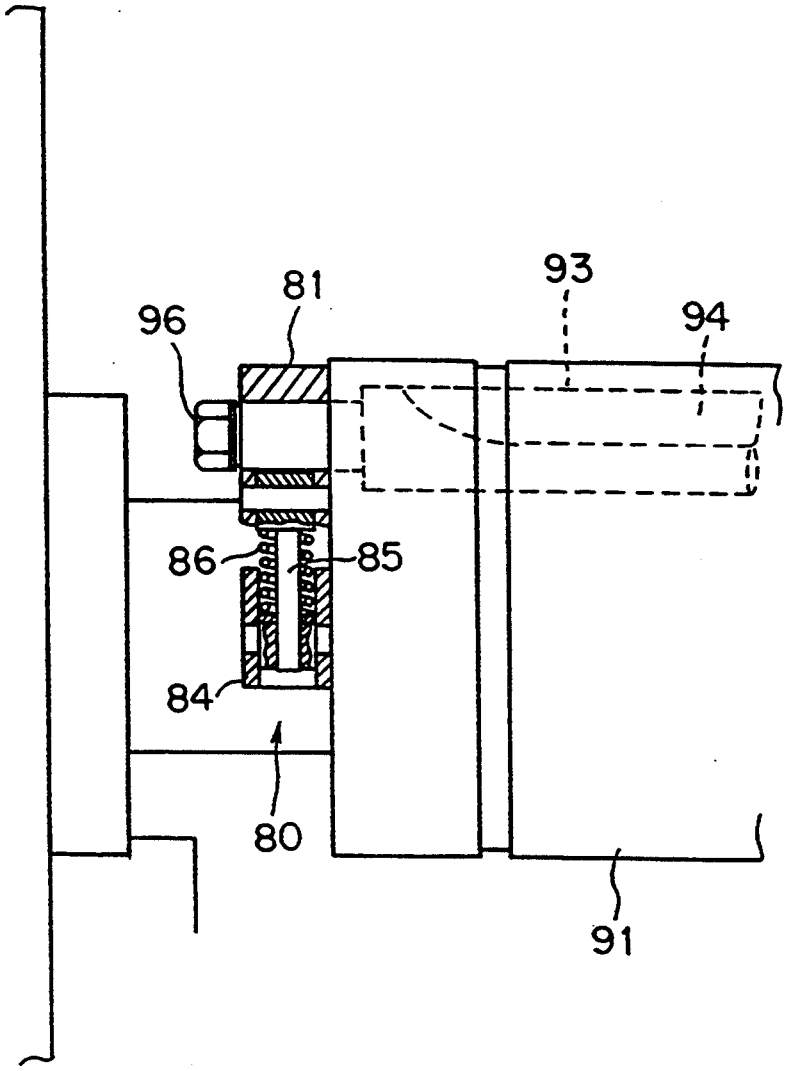
FIG.24 PRIOR ART
FIG. 24 is a partly sectional axial view showing a prior art example.

FIGS. 1 and 2 show an embodiment of the invention applied to the printing plate mounting apparatus. This embodiment of the printing plate mounting apparatus 101 is based on the printing plate mounting apparatus 90 described before in connection with FIGS. 24 to 26. Its printing cylinder 91, lock shaft 93 and toggle mechanism 80 are the same as those described before and are thus not described here, and only newly added portions will be described.

The lock shaft 93 is provided at its end with a hexagon nut 96, on which a printing plate replacement lever member 11 is fitted. The lever member 11 has a de-mounting and a mounting lever 12 and 13, these levers being provided on its opposite sides.

More specifically, the de-mounting and mounting levers 12 and 13 are provided circumferentially forward and rearward of the printing cylinder 91 with respect to the lock shaft 93, respectively, and their free ends are adapted to be moved toward the center of the printing cylinder 91 with rotation of the lock shaft 93.

To retain the printing plate replacement lever member 11, the shaft 97 of the printing cylinder 91 is provided with a stopper 14 capable of sliding along the member 11.

Air cylinders 21 and 31 having printing plate replacement drive functions are provided on a frame 98 supporting the shaft 97 of the printing cylinder 91. The air cylinders 21 and 31 and de-mounting and mounting levers 12 and 13 constitute lock shaft drive means 901.

The air cylinders 21 and 31 have respective push rods 22 and 32 each serving as a contact member to be advanced and retreated with respect to the printing cylinder 91.

The push rods 22 and 23 are set such that their free ends face the de-mounting or mounting lever 12 or 13 when the printing cylinder 91 is at the mounting and de-mounting positions, i.e., at a printing plate replacement position with the lock shaft 93 in direction A as shown in FIG. 2. They have sufficient strokes of advancement to cause rotation of the lever member 11 in contact with the levers 12 and 13.

A rotation controller (not shown) for the printing cylinder 91 has a rotary encoder, limit switches, etc. for detecting the angular position of the printing cylinder 91, and the printing cylinder 91 can be stopped at a predetermined replacement position A according to detection signal thus obtained.

In this embodiment, in normal printing operation the push rods 22 and 32 of the air cylinders 21 and 31 are held retreated so that they will not interfere with the levers 12 and 13 of the rotating printing cylinder 91.

When replacing the printing plate, the air cylinders 21 and 31 are operated in succession to switch the lock and unlock states of the lock shaft 93 for effecting the de-mounting of the printing plate and mounting of a separate printing plate.

First, the printing cylinder 91 is stopped at the printing plate replacement position A. Then, by operating the de-mounting cylinder 21 the push rod 22 is advanced to bring its end into contact with the de-mounting lever 12 and further advanced to push the de-mounting lever 12 to cause rotation of the printing plate replacement lever member 11 and lock shaft 9 in the unlocking direction.

Figure 25:
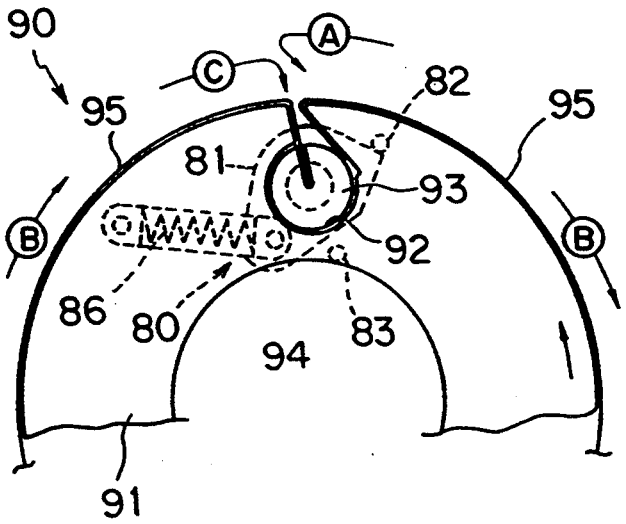
FIG.25 PRIOR ART
FIGS. 25 and 26 are schematic transversal sectional views illustrating the operation of the same prior art example.
Figure 26:
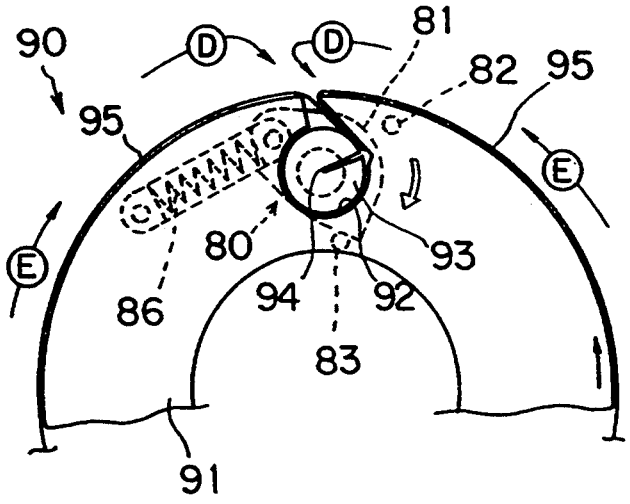
FIG.26 PRIOR ART
Figure 27:
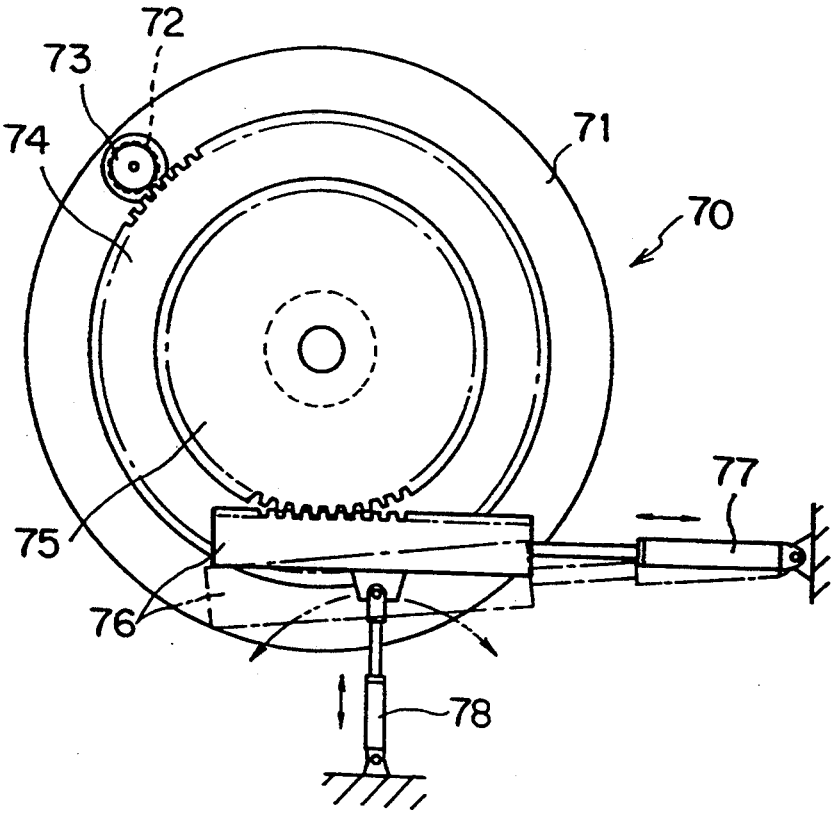
FIG.27 PRIOR ART
FIG. 27 is a schematic transversal sectional view showing a different prior art example.

With the rotation of the member 11 in the unlocking direction, the lock shaft 93 is moved from the state shown in FIG. 26 to the state shown in FIG. 25 noted above, thus releasing the lock of the ends of the printing plate by the lock shaft 93.

When the lock is released, the push rod 22 of the de-mounting air cylinder 21 is retreated.

In this state, the trailing end of the printing plate to be replaced is taken out, then the printing cylinder 91 is reversely rotated by one rotation, and the printing plate is pulled from its trailing end having been taken out to remove the leading plate end from the cavity 92. In this way, the printing plate is removed from the printing cylinder 91.

Subsequently, the leading end of a separate is inserted in the cavity 92 and hooked in a bent state. Then, the printing cylinder 9 is rotated forward by one rotation, and the trailing end of the printing plate is inserted in the slit 94. In this way, the printing plate is wound loosely on the printing cylinder 91.

Then, the printing cylinder 91 is stopped at the replacement position A, and by operating the mounting air cylinder 31 the push rod 32 is advanced to bring its end into contact with the mounting lever 13 and further advanced to push the mounting lever 13 so as to cause rotation of the lever member 11 and lock shaft 9 in the locking direction.

With the rotation in the locking direction, the lock shaft 93 is moved from the state shown in FIG. 25 to the state shown in FIG. 26. In this way, the ends of the printing plate are locked by the lock shaft 93, and the printing plate is thus mounted under a predetermined tension on the periphery of the printing cylinder 91.

When the lock is effected, the push rod 32 of the mounting air cylinder 31 is retreated.

By so doing, the printing cylinder 91 is made rotatable and ready for printing with the new printing plate.

As shown, with this embodiment the lock shaft 93 may be rotated in the unlocking or locking direction by pushing the de-mounting or mounting lever 12 or 13 with the de-mounting or mounting air cylinder 21 or 31.

It is thus readily possible to remote control operate or obtain automatic operation of the air cylinders 21 and 31 and preclude manual operation in the replacement of the printing plate. Thus, it is possible to improve the operation efficiency.

Particularly, the advancement and retreat of the push rods 22 and 32 directly cause coupling and de-coupling between the printing cylinder 91 and the frame 98, thus dispensing with hi-directional motion for on/off controlling the drive power transmission as in the prior art gear type printing plate mounting mechanism.

Thus, it is possible to obtain stable operation at all times, simplify the structure and simplify the method and procedure of the operation control.

Further, the instant embodiment can be readily constructed by directly utilizing the prior art manual printing plate mounting mechanism 90, providing the air cylinders 21 and 31 on the frame 98, fitting the printing plate replacement lever member 11 on the hexagon nut 96 at the end of the lock shaft 93 and retaining the member 11 with the stopper 14. Thus, it can be constructed without need of any large scale modification and can be readily obtained, thus permitting reduction of the installation cost.

Further, since this embodiment uses the two air cylinders 21 and 31 for de-mounting and mounting the printing plate, the printing cylinder 91 may be stopped at the same position A for the de-mounting and mounting of the printing plate. It is thus possible to simplify the operation and apparatus necessary for the positioning of the printing cylinder 91.

FIGS. 3 to 8 show a different embodiment of the invention applied to the printing plate mounting apparatus.

Figure 9:
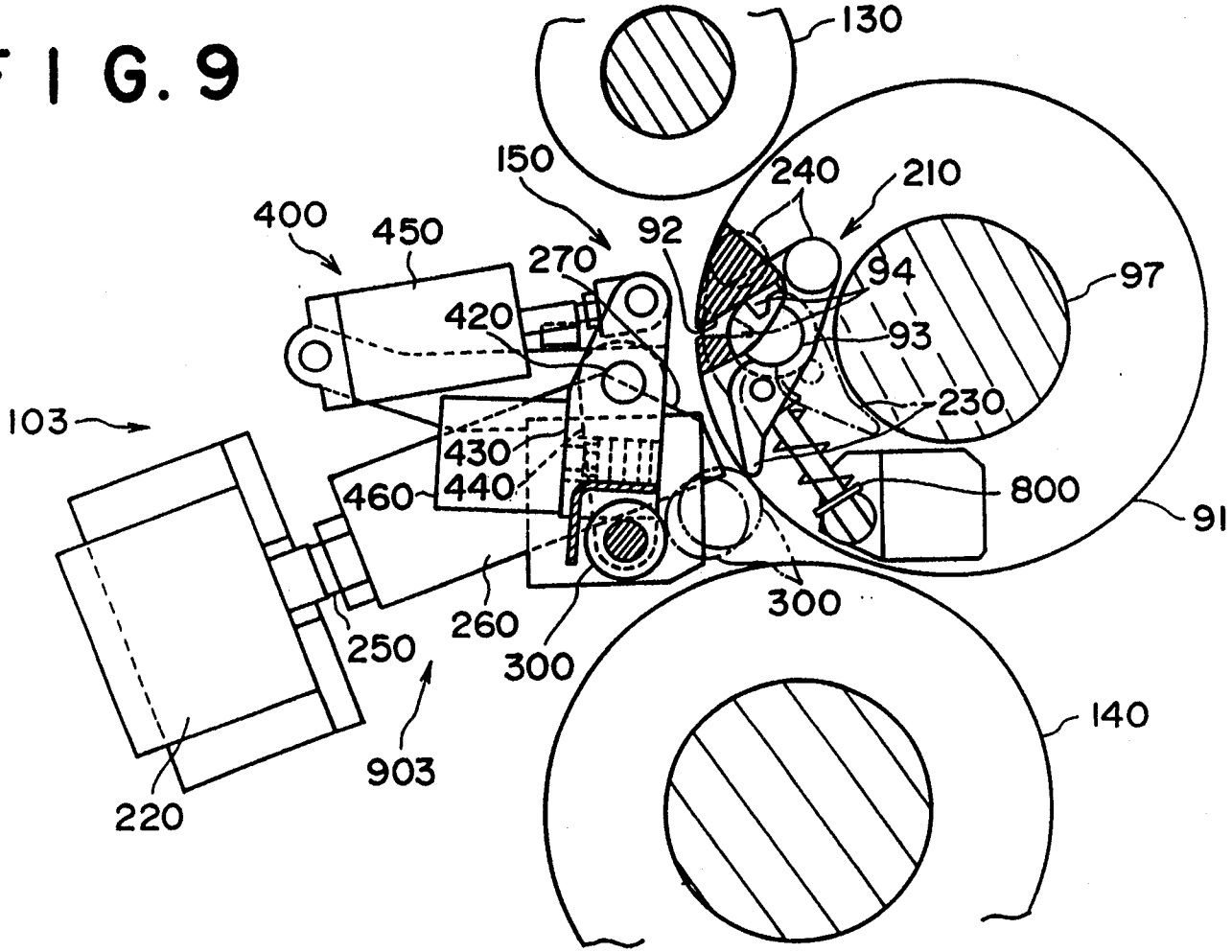
FIG. 9 is a transversal sectional view showing a further embodiment of the invention applied to the printing plate replacement apparatus.
Figure 10:
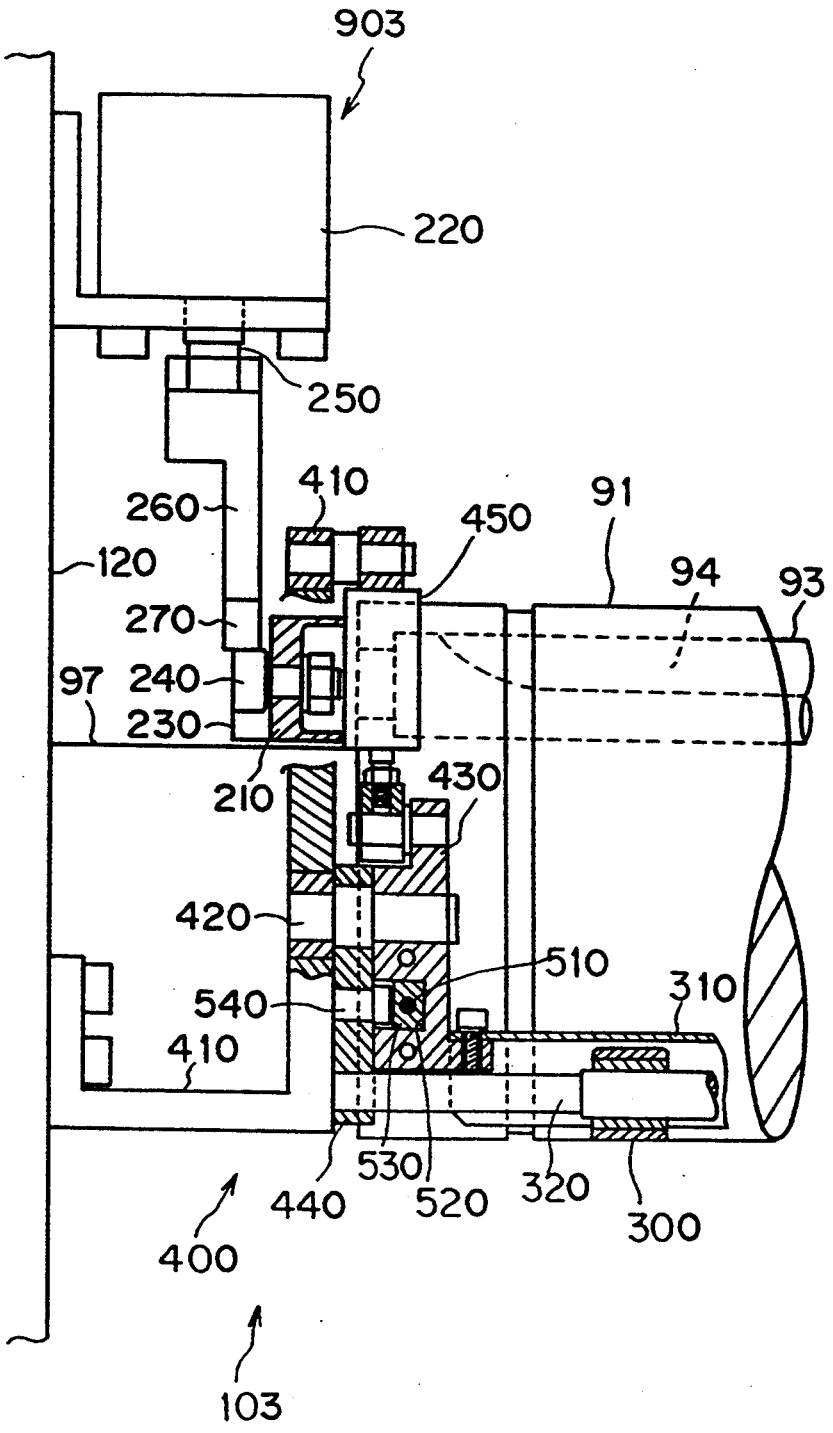
FIG. 10 is a partly sectional axial view showing a portion of the same embodiment in the neighborhood of one end of a printing cylinder.
Figure 11:
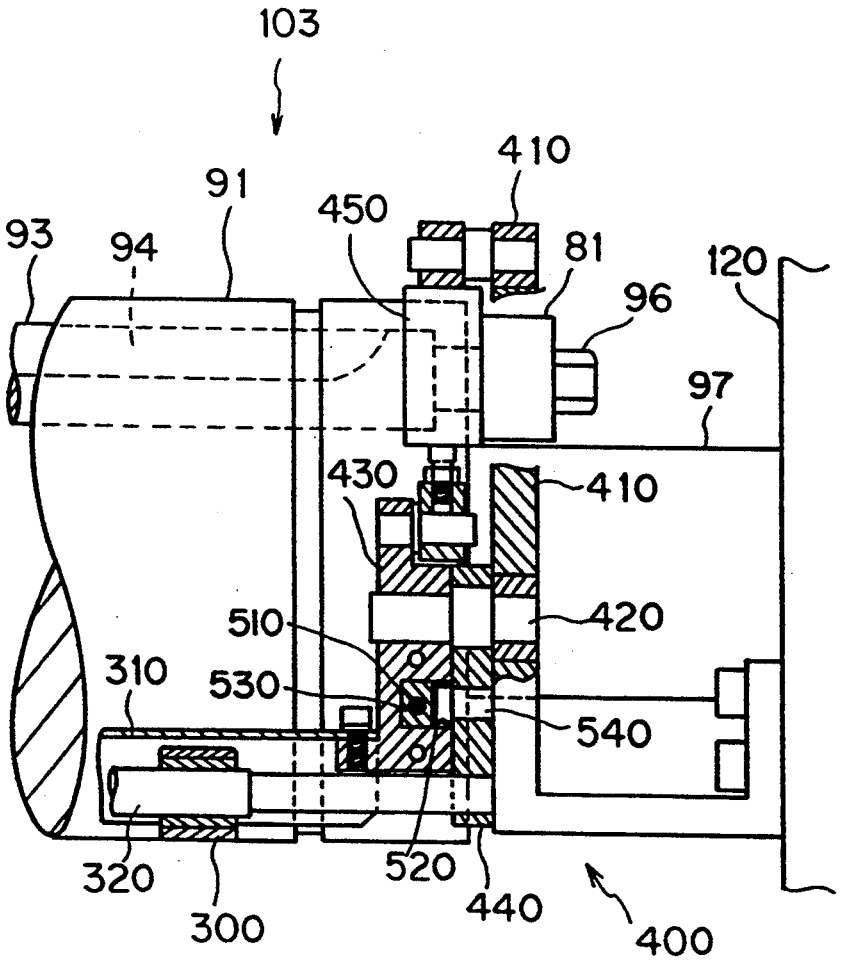
FIG. 11 is a partly sectional axial view showing a portion of the same embodiment in the neighborhood of the other end of the printing cylinder.

This embodiment of the printing plate mounting apparatus 102, like the preceding embodiment, is based on the printing plate mounting apparatus shown in FIGS. 9 to 11. That is, printing cylinder 91, lock shaft 93 and toggle mechanism 80 are the same as described before. Thus, like parts are not described, and only different parts will be described.

Figure 3:
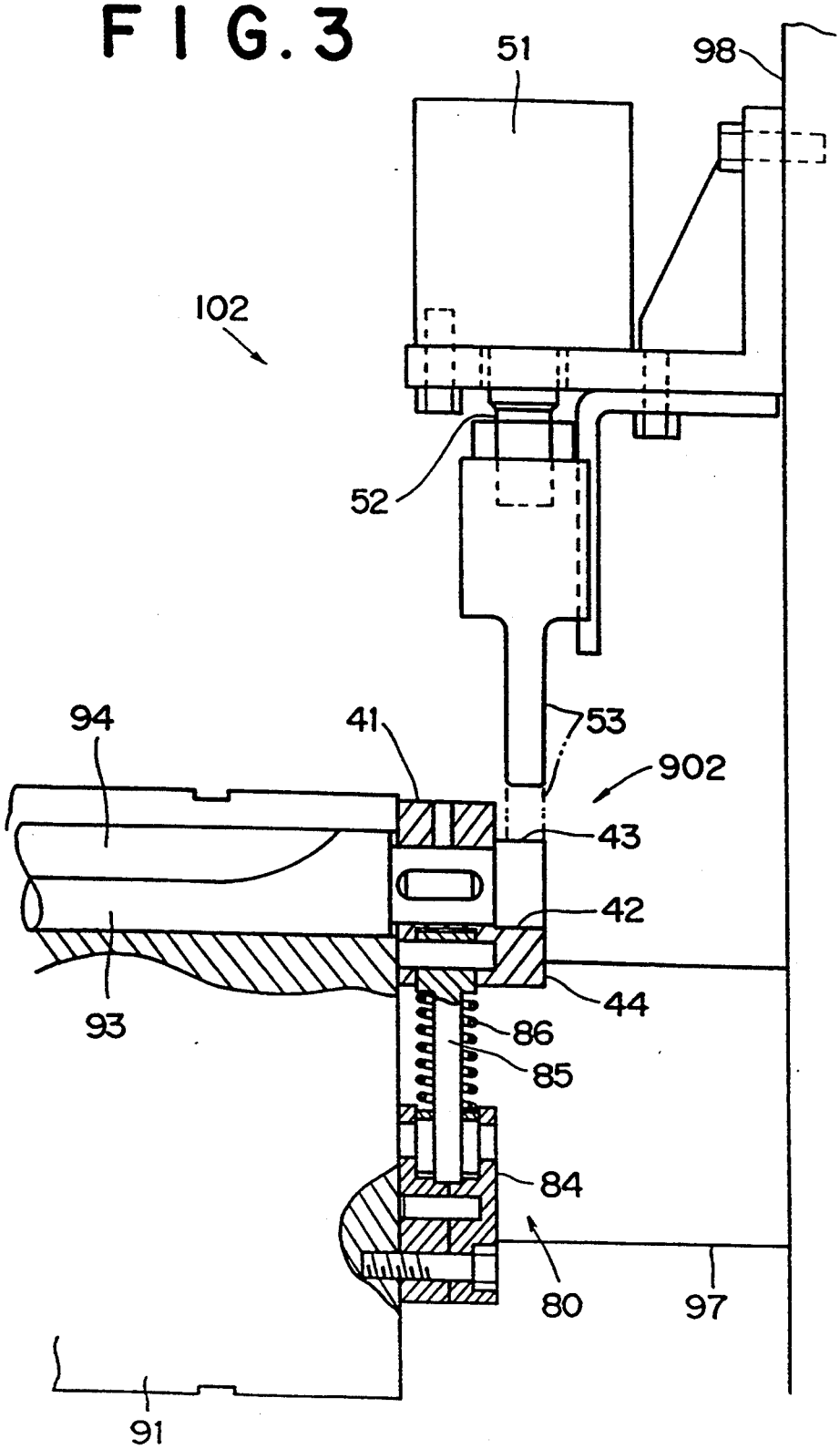
FIG. 3 is a partly sectional axial view showing a different embodiment of the invention applied to the printing plate mounting apparatus.
Figure 4:
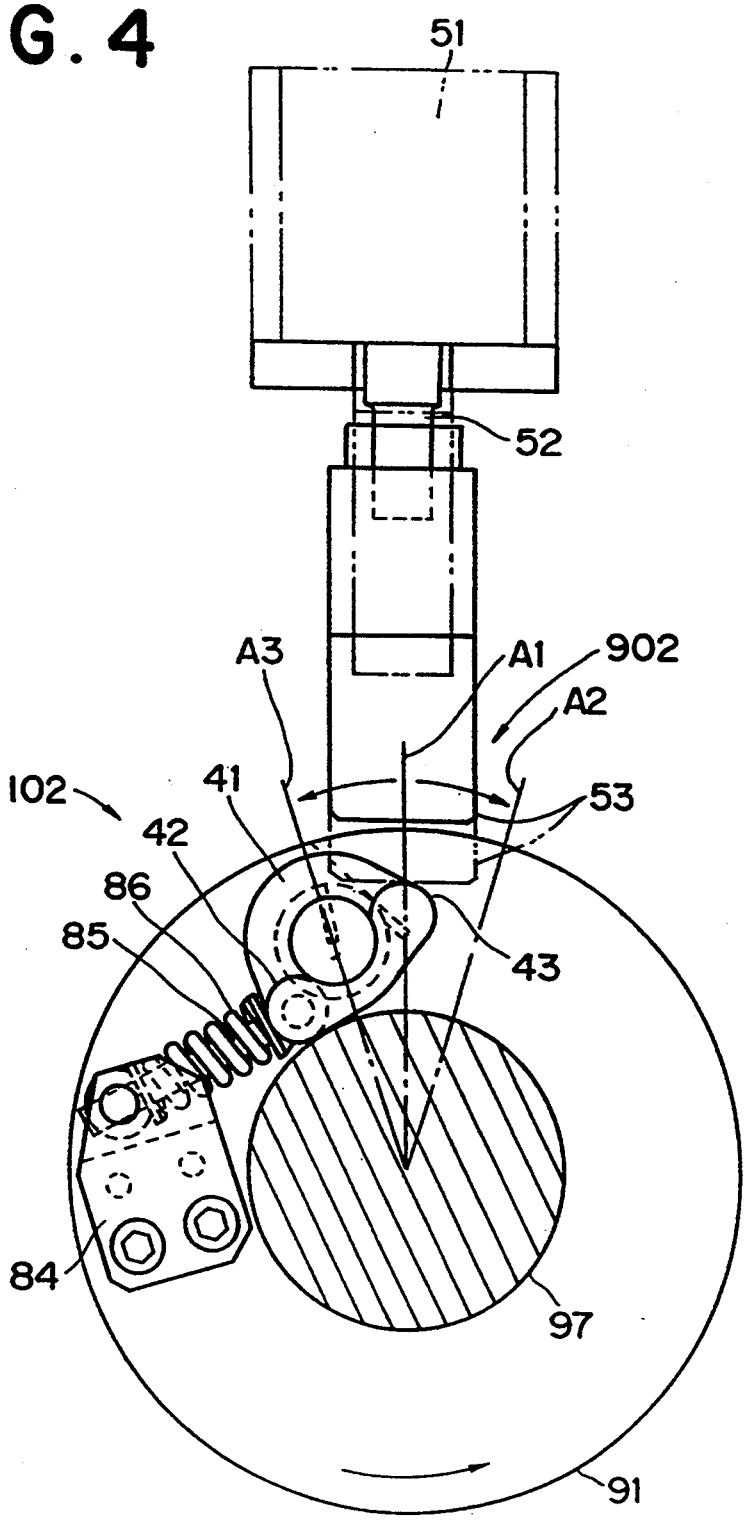
FIG. 4 is a transversal sectional view showing the same embodiment.

Referring to FIGS. 3 and 4, a printing plate replacement lever block 41 is mounted in lieu of rotary block 81 on the end of the lock shaft 93.

The printing plate replacement lever block 41 is basically the same in shape as the rotary block 81 except that its end face has an integral projection 44.

The projection 44 has a de-mounting and a mounting lever 42 and 43.

The de-mounting and mounting levers 42 and 43 are disposed circumferentially forward and rearward of the printing cylinder 91 with respect to the lock shaft 91. They are adapted such that their free ends are directed toward the center of the printing cylinder 91 with the rotation of the lock shaft 93.

Frame 98 supporting shaft 97 of the printing cylinder 91 has an air cylinder 51 serving as printing plate replacement drive means. The air cylinder 51 and de-mounting and mounting levers 42 and 43 constitute mounting drive means 902 of this embodiment.

The air cylinder 51 has a push rod 52 serving as a contact member to be advanced and retreated to and from the printing cylinder 91.

The push rod 53 is set such that it faces the de-mounting lever 42 when the printing cylinder 91 is at the de-mounting position, i.e., a position with the lock shaft 93 in direction A2 in FIG. 4, corresponding to a position of the lock shaft 93 a predetermined angle leading position A1 to face the air cylinder 51, and that it faces the mounting lever 43 when the printing cylinder is at the mounting position, i.e., a position with the lock shaft 93 in direction A3 in FIG. 4, corresponding to a position of the lock shaft 93 a predetermined angle lagging behind the position A1. It can be brought into contact with he cylindrical periphery of the levers 42 and 43 by causing advancement of the push rod 52 at positions A2 and A3.

The push rod 52 of the air cylinder 51 has sufficient stroke for the push rod 53 to be advance subsequent to the contact to push the levers 42 and 43 so as to cause rotation of the printing plate replacement lever block 41.

The end of the push rod 53 is flattened in the direction of the end face of the printing cylinder 91, and its edge has a length capable of maintaining the frictional contact at all times irrespective of the displacement of the levers 42 and 43 caused by the rotation of the lever block 41.

Rotation control means (not shown) for the printing cylinder 91 has a rotary encoder, limit switches, etc. for detecting the angular position of the printing cylinder 91. According to detection signal thus obtained, the printing cylinder 91 is stopped at the predetermined de-mounting and mounting positions A2 and A3 noted above.

In this embodiment having such construction as above, in normal printing operation the push rod 52 of the air cylinder 51 is held retreated so that it will not interfere with the levers 42 and 43 of the rotating printing cylinder 91.

When replacing the printing plate, the stop position of the printing cylinder 91 is selected, and the air cylinder 51 is operated to switch the lock and unlock states of the lock shaft 93, thus effecting the de-mounting of the printing plate to be replaced and mounting of a new printing plate.

Figure 5:
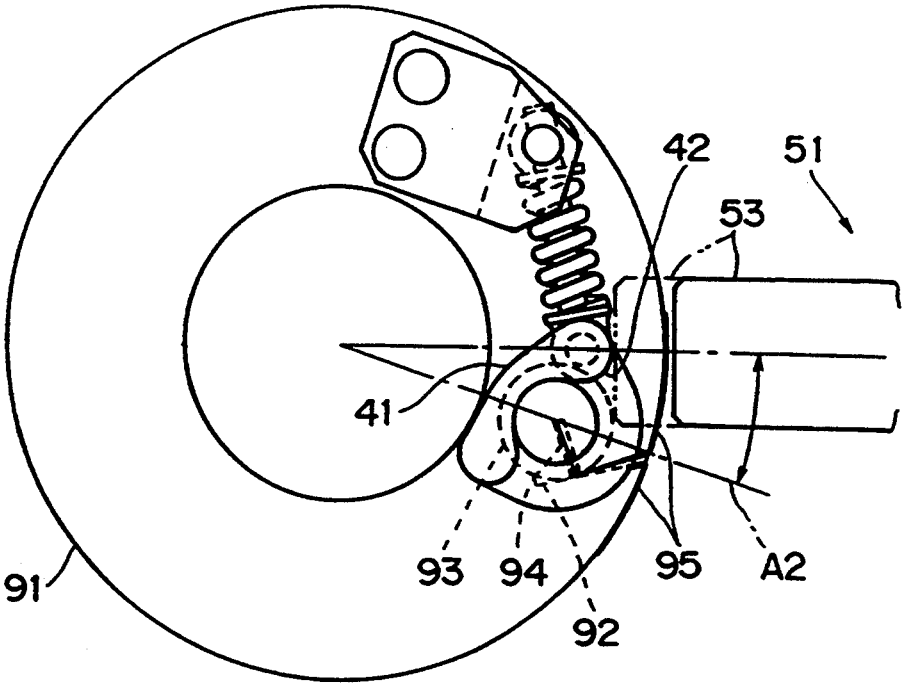
FIGS. 5 to 8 are transversal sectional views illustrating the operation of the same embodiment.

First, as shown in FIG. 5, the printing cylinder 91 is stopped at the de-mounting position A2. Then, the air cylinder 51 is operated to cause advancement of the push rod 53 so as to bring the end thereof into contact with the de-mounting lever 42.

Figure 6:
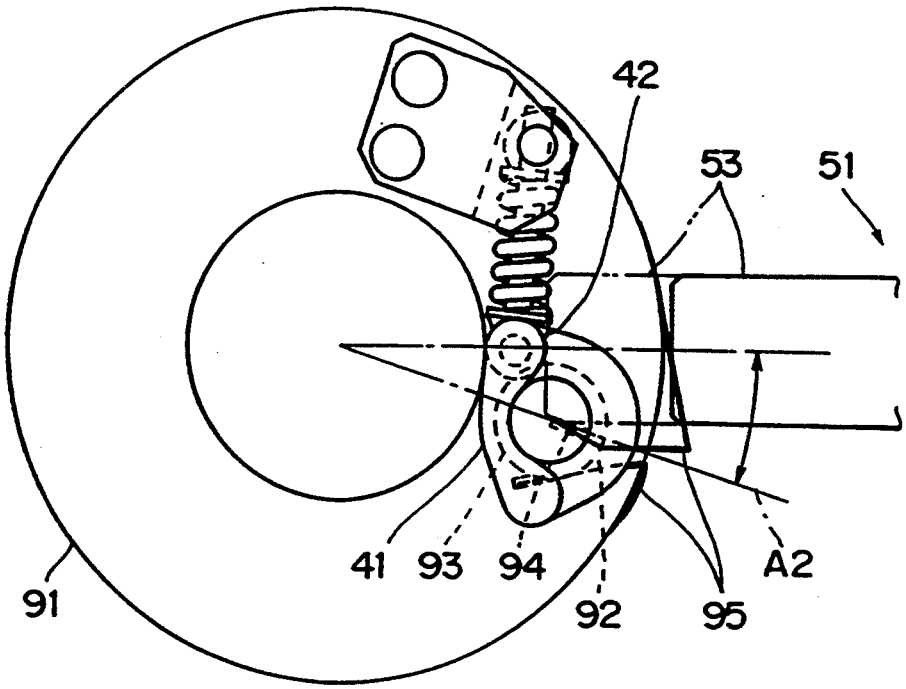

Then, the push rod 53 is further advanced, as shown in FIG. 6, thus pushing the printing plate replacement lever block 41 and rotating the lock shaft 93 in the unlocking direction.

With the rotation of the lock shaft in the unlocking direction, the slit 94 of the lock shaft 93 comes to the position corresponding to the opening of the cavity 92, thus releasing the lock of the ends of the printing plate 95 by the lock shaft 93.

When the lock is released, the push rod 52 or 53 of the air cylinder 51 is retreated.

In this state, the trailing end of the printing plate to be replaced is taken out from the slit 94, then the printing cylinder 91 is reversely rotated by one rotation, then the printing plate 95 is separated from the side of the taken-out trailing end, and then the leading end (or head) of the plate having been hooked in the cavity 92 is taken out. In this way, the printing cylinder 95 is removed from the printing cylinder 95.

Subsequently, the leading end of a different printing plate is inserted in the cavity 92 and hooked in a bent state, then the printing cylinder 91 is forwardly rotated by one rotation, and then the trailing end of the printing cylinder 95 is inserted in the slit 94, thus effecting loose winding of the printing plate on the printing cylinder 91.

Figure 7:
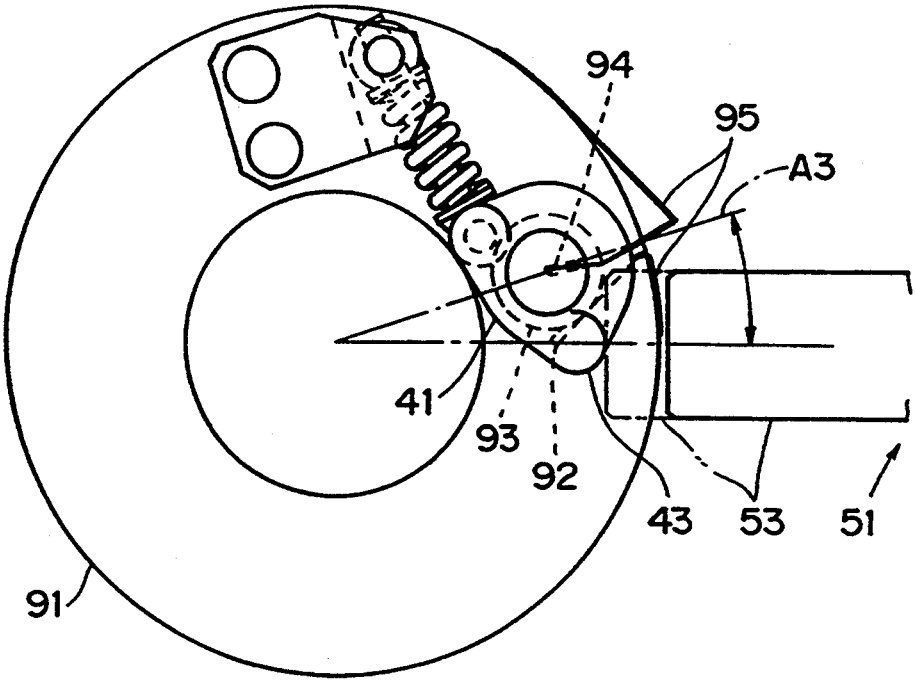

Then, as shown in FIG. 7, the printing cylinder 91 is stopped at the mounting position A3, and the air cylinder 51 is operated to advance the push rod 53 so as to bring the end thereof into contact with the mounting lever 43.

Figure 8:
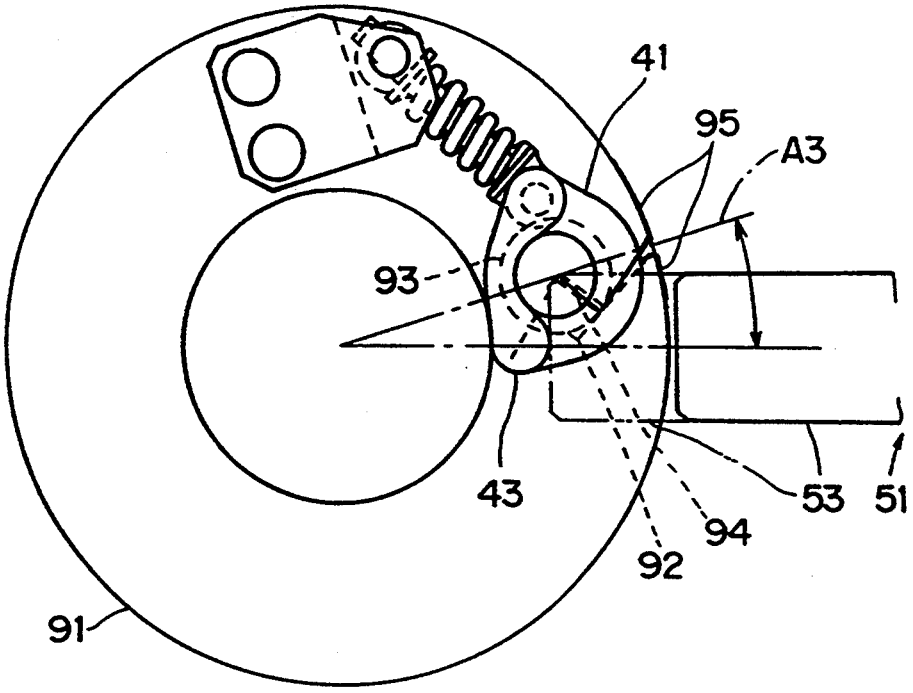

Then, as shown in FIG. 8, the push rod is further advanced to push the mounting lever 43 so as to rotate the lever block 41 and lock shaft 93 in the locking direction.

With this rotation in the locking direction, the lock shaft 93 is rotated to bring its slit 94 into the cavity 92, and the ends of the printing plate are taken in and locked by the lock shaft 93. In this way, the printing plate is mounted under a predetermined tension on the periphery of the printing cylinder 91.

When the lock is effected, the push rods 52 and 53 of the air cylinder 51 are retreated.

Thus, the printing cylinder 91 is rotatable and ready for printing with the newly mounted printing plate 95.

With this embodiment having the above construction, the lock shaft 93 can be rotated to the unlock or lock state by pushing the de-mounting or mounting lever 42 or 43 with the printing plate replacement air cylinder 51. It is thus possible to obtain the same effects as in the previous first embodiment, i.e., simplification of the structure, stability of operation, and improvement of the operation efficiency.

Further, with this embodiment it is possible to let the single printing plate replacement air cylinder 51 commonly provide for the operations of the de-mounting and mounting levers 42 and 43 by selecting the stop positions A2 and A3 of the printing cylinder 91. It is thus possible to make the structure size smaller than that of the previous first embodiment. In addition, since air piping, control valves, etc. for driving the air cylinder 51 can be simplified, it is possible to further reduce the installation cost and more readily carry out the invention.

Now, a further embodiment of the invention applied to the printing plate replacement apparatus will be described.

Referring to FIGS. 9 to 12, this embodiment of the printing plate replacement apparatus comprises, in addition to printing plate mounting apparatus 103 including printing cylinder 91, lock shaft 93, toggle mechanism 800 and lock shaft drive means 903 for rotating the lock shaft 93, a roller 300 for rolling over the periphery of the printing cylinder 91 in a state urged thereagainst, and roller drive means 400 for releasing the roller 300 from the urged state thereof.

The printing cylinder 91 is as described before in connection to FIGS. 24 to 26, and it is not described here. The lock shaft drive means 903, roller 300 and roller drive means 400, which constitute a new structure, will now be described.

The lock shaft drive means 903 includes a lever block 210 mounted on an end of the lock shaft 93 and an air cylinder 220 for rotating the lever block 210. In this embodiment, the air cylinder 220 constitutes printing plate replacement drive means.

The lever block 210, as shown in FIG. 10, is mounted in lieu of the rotary block 81 and hexagon nut 96 noted before on one end of the lock shaft 93.

The rotary block 81 and hexagon nut 96 remain on the other end of the lock shaft 93, as shown in FIG. 11, permitting manual operation of the lock shaft 93 using a spanner or the like.

The lever block 210 has an integral de-mounting lever 230, which is constituted by a projection having a cylindrical surface and a projecting portion, and a mounting lever 240 projects from a cylindrical head of a bolt, to which a nut is secured.

The de-mounting and mounting levers 230 and 240 are disposed circumferentially forward and rearward of the printing cylinder 91 with respect to the lock shaft 93, and their ends are adapted to be moved toward the center of the printing cylinder 91 with the rotation of the lock shaft 93.

The de-mounting and mounting levers 230 and 240 are restricted against their motion toward the center of the printing cylinder 91 when they are brought into contact with the shaft of the printing cylinder 91. In addition, they do not project from the periphery of the printing cylinder 91 even when they are moved to their outermost position with respect to the printing cylinder 91, so that they will not interfere with the other components even during the rotation of the printing cylinder 91.

The lever block 210 and the lock shaft 93 are positionally related to each other such that the lock shaft 93 is at the unlock position CR, i.e., a position, at which the slit 94 faces the opening of the cavity 92 as shown phantom line in FIG. 9, when the de-mounting lever 230 is brought to be closest to the shaft 97, and that the lock shaft 93 is at the lock position CS, i.e., at a position, at which the slit 94 is concealed in the cavity as shown by solid line in FIG. 9, when the mounting lever 240 is brought to be closest to the shaft 97.

The air cylinder 220 is supported on the frame 120 supporting the shaft 97 of the printing cylinder 97 and faces the lever block 210 via a gap portion 150 between an inking roller 130 rolling over the printing cylinder 91 and a blanket cylinder 140.

The air cylinder 220 has a contact member 260 provided at the end of a push rod 250 for being advanced and retreated with respect to the lever block 210.

Figure 15:
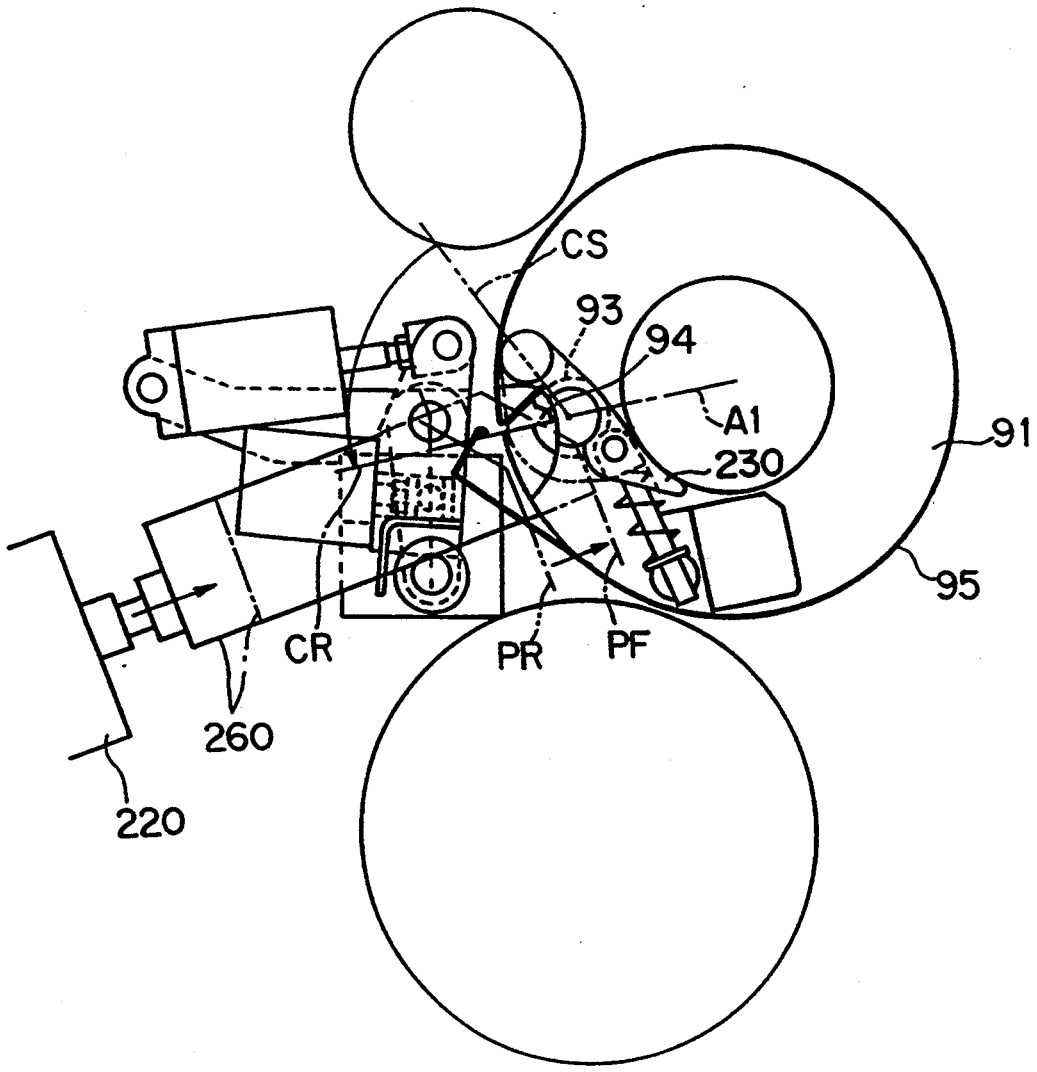

The contact member 260 is held at an advanced or forward position PR as shown by phantom line in FIG. 15 with the air cylinder 220 at the fully advanced position and held at a retreated or rearward position PR as shown by solid line in FIG. 15 with the air cylinder at the fully retreated position.

Figure 13:
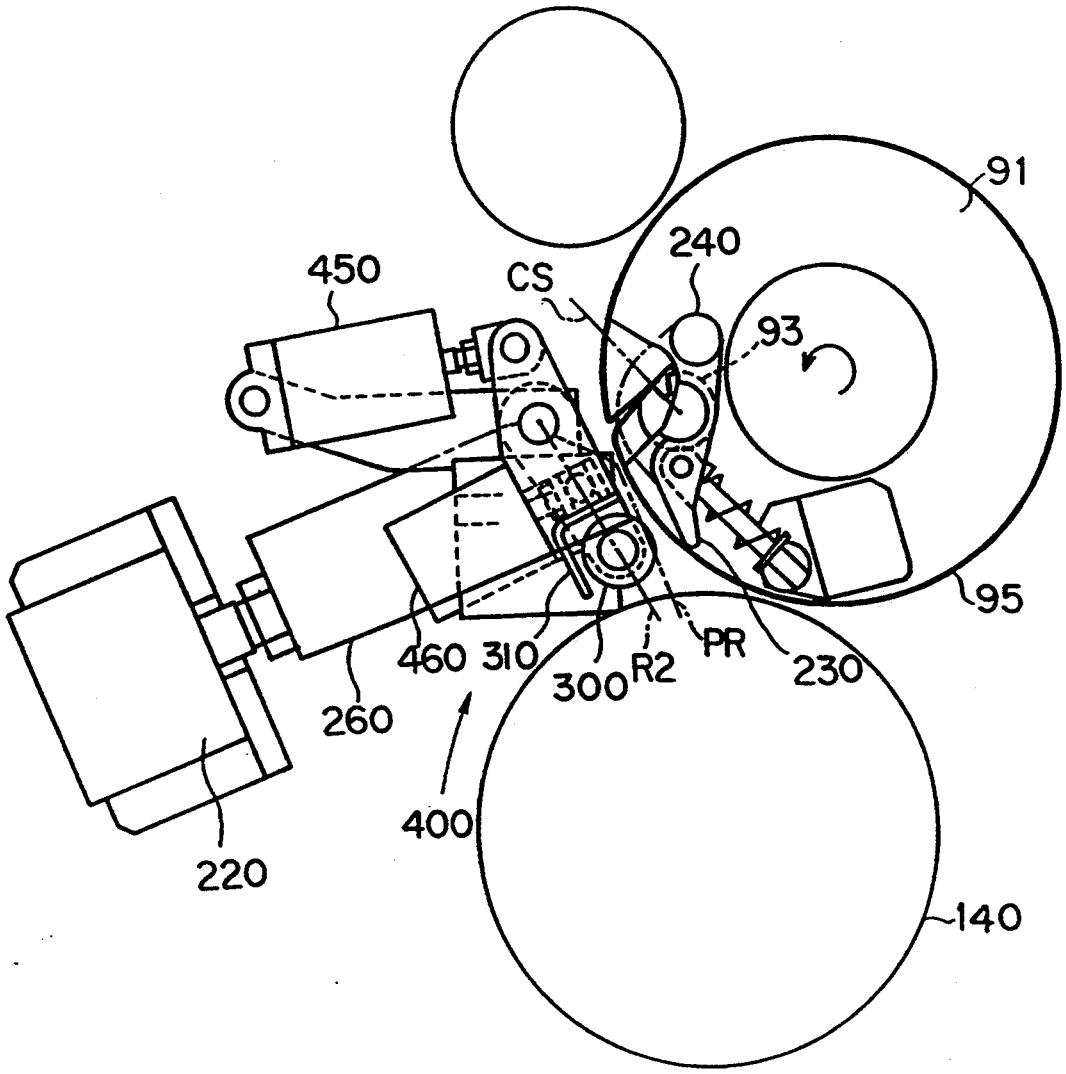
FIGS. 13 to 21 are schematic transversal sectional views illustrating the operation of the same embodiment.
Figure 14:
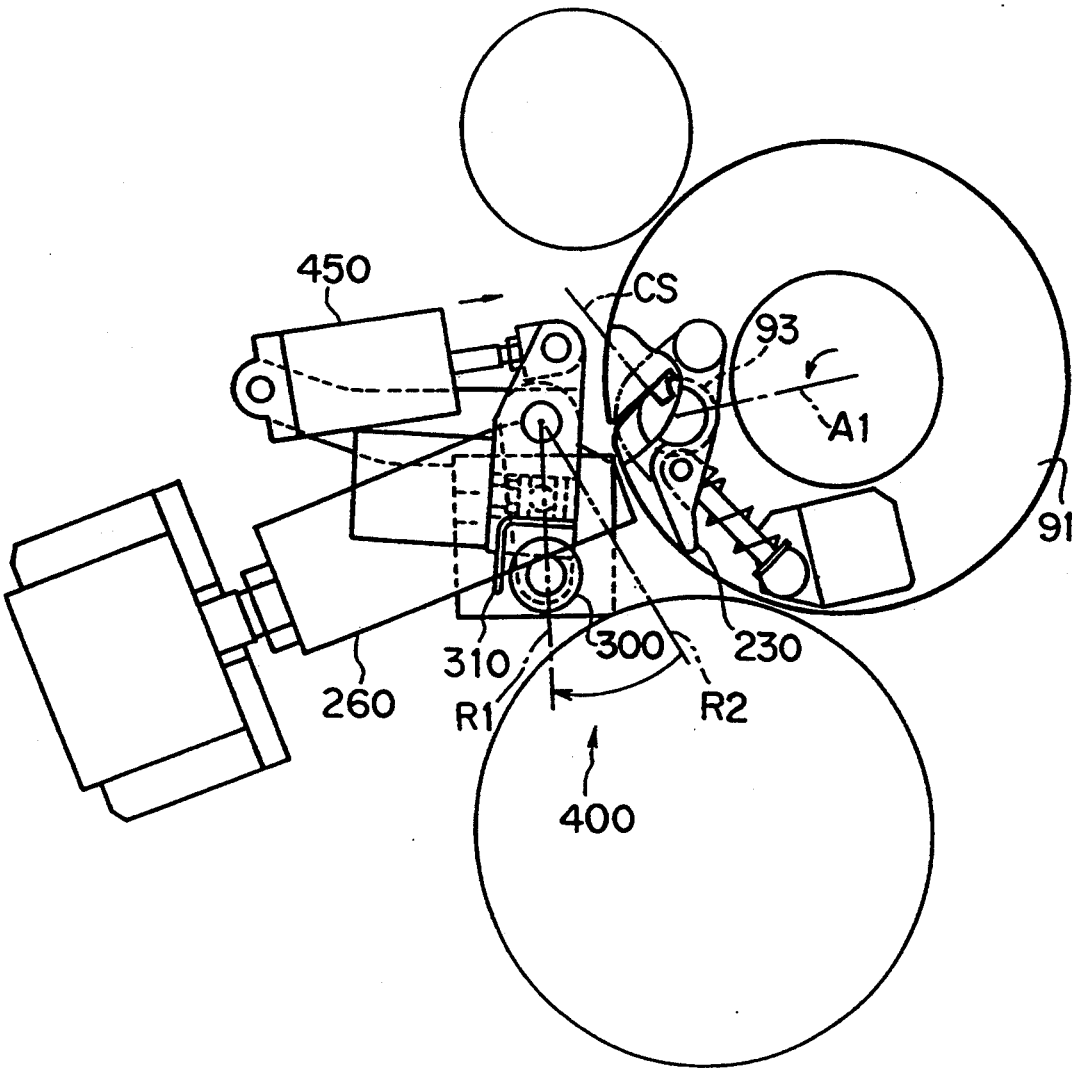

The contact member 260 faces the de-mounting lever 230 when the printing cylinder 91 is at the de-mounting position A1, i.e., a position corresponding to the neighborhood of a predetermined position of the lock shaft 93 substantially at the center of the gap 150, as shown in FIGS. 13 to 15, and when it is advanced to the forward position PF, its end faces is brought into contact with the de-mounting lever 230 at the lock position CS for rotating the lock shaft 93 to the unlock position CR.

Figure 16:
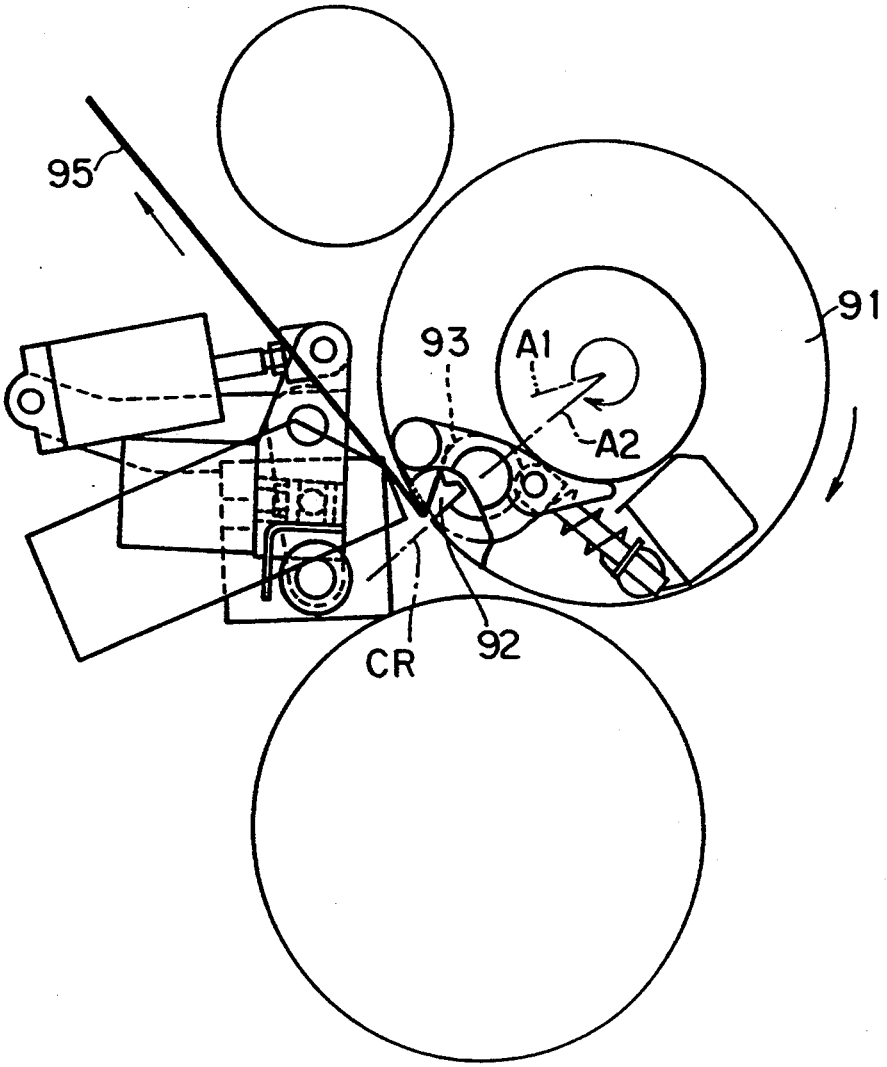
Figure 17:
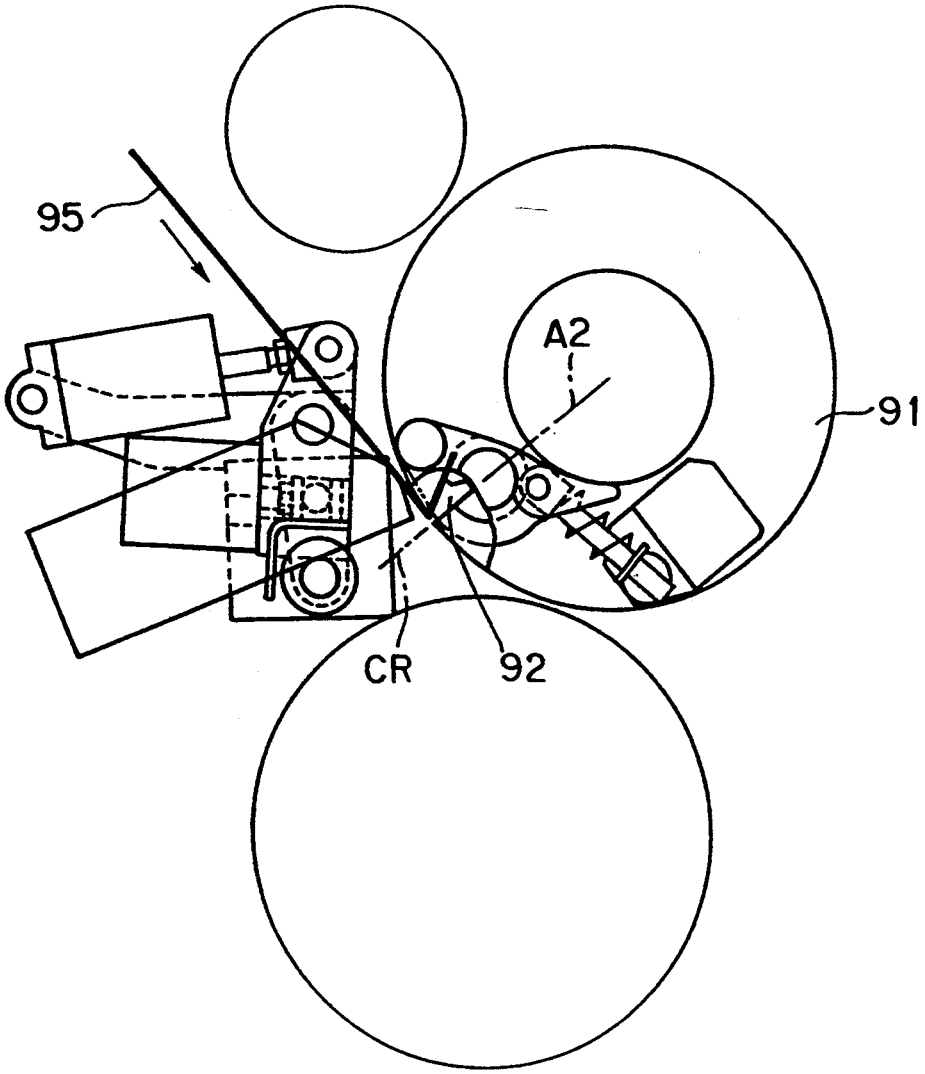
Figure 18:
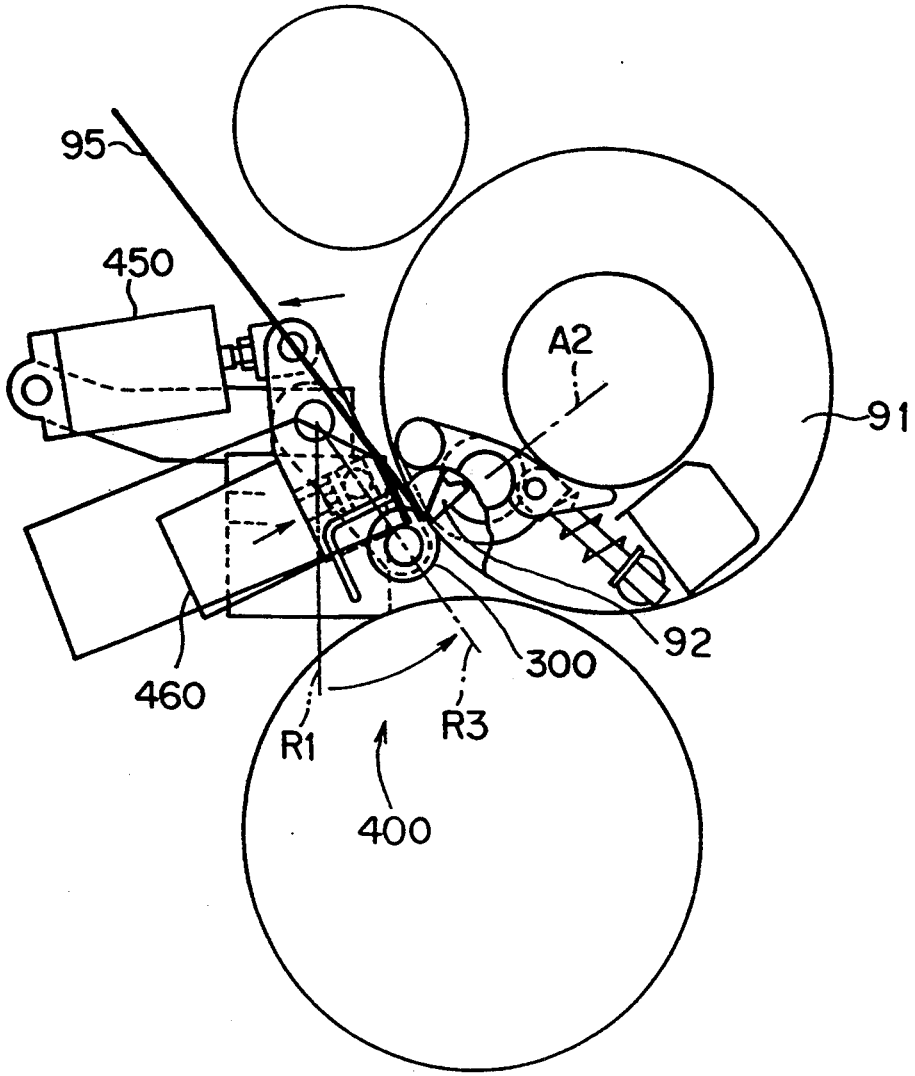

Also, the contact member 260 faces the mounting lever 240 when the printing cylinder 91 is at the mounting position A2, i.e., a position corresponding to the neighborhood of a position lagging behind the de-mounting position A1 by a predetermined angle, as shown in FIGS. 16 to 18, and when it is advanced to the forward position PF, its end face is brought into contact with the mounting lever 240 at the unlock position for rotating the lock shaft 93 to the lock position CS.

One corner of the end of the contact member 260 is formed with an inclined cam 270.

Figure 20:
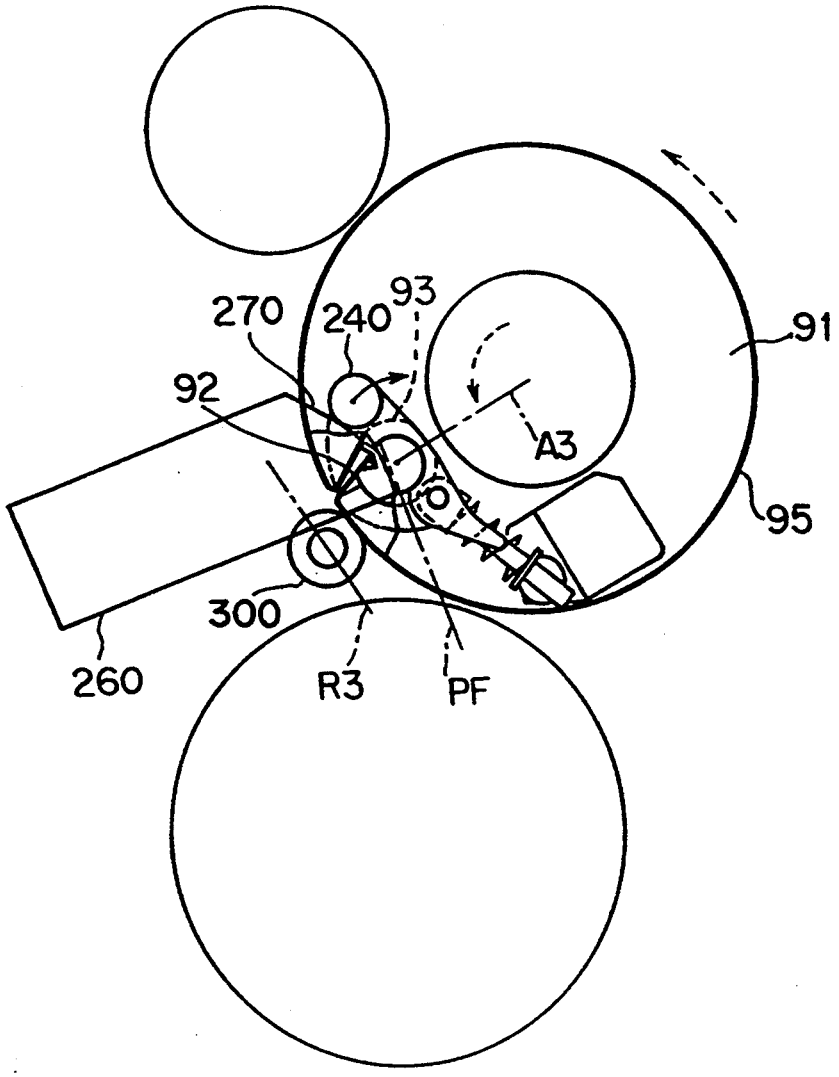

The inclined cam 270 permits forward rotation of the printing cylinder 91 with the contact member 260 at the forward position PF and the lock shaft 93 at the unlock position CR, and can engage with the mounting lever 240 upon reaching of the clamping start position A3, i.e., a position lagging behind the de-mounting position A1 by a predetermined angle, as shown in FIG. 20.

The inclined cam 270 has an inclined cam surface such that with further rotation of the printing cylinder 91 it guides the mounting lever 240 in sliding contact with the cam surface toward the shaft 97 for rotating the lock shaft 93 toward the lock position CS.

The cam surface of the inclined cam 270 and the end face of the contact member 26 are continuous to each other at a position of sliding contact with the mounting lever 240 upon reaching of the neighborhood of the mounting position A2 by the printing cylinder 91. With the rotation of the printing cylinder 91 the mounting lever 240 having been sliding over the inclined cam 270 comes to be in sliding contact with the end face of the contact member 260 in the neighborhood of the mounting position A2, and in this state the lock shaft 93 reaches the lock position CS.

Roller drive means 400 is disposed near the contact member 260. The roller 300 is supported by the roller drive means 400.

The roller 300 has its periphery made of rubber or like elastic material, and it is urged by the roller drive means 400 against the printing cylinder 91 for rolling over the same.

The roller drive means 400 has brackets 410 each provided on each side inner surface of a frame 120. Each bracket 410 carries a rotary pin 420 extending parallel to the shaft 97 of the printing cylinder 91.

The rotary pins 420 each support a rotatable escapement arm 430 and an also rotatable urging arm 440.

Each of the escapement arms 430 is connected to the end of the bracket 410 via an escapement cylinder 450 and rotated with the advancement and retreat of the escapement cylinder 450.

Each of the urging arms 440 has one end rotatably coupled to the escapement arm 430 and also has an intermediate portion connected to an urging cylinder 460 secured to the escapement arm 430.

Figure 12:
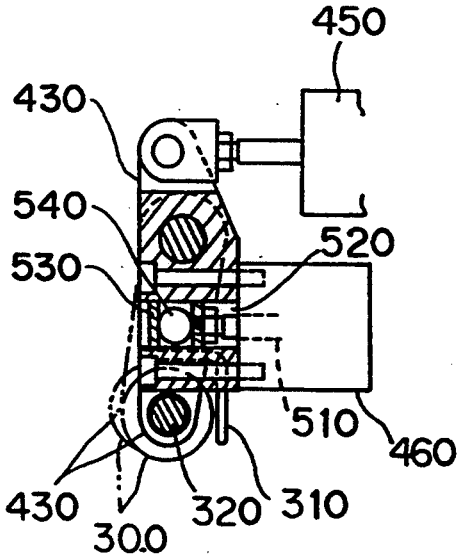
FIG. 12 is a sectional view showing an essential part of roller drive means in the same embodiment.

AS shown in FIG. 12, a push rod 510 of the urging cylinder 460 has its end connected to an end member 530 which is movable along a guide groove 520 formed in the escapement arm 430.

A pin 540 is connected to one side of the urging arm 440, and it is coupled to the end member 530.

The urging arm 440 is thus rotated with respect to the escapement arm 430 as it causes advancement and retreat of the urging cylinder 460.

The opposite side urging arms 440 have their ends bridged by a safety bar 310 having a substantially L-shaped sectional profile and also bridged by a shaft 320 along the safety bar 310. The shaft 320 supports the roller 300 for rotation.

The roller drive means rotates both the escapement and urging arms 430 and 440 away from the printing cylinder 91, whereby the roller 300 is separated greatly from the printing cylinder 91 and brought to an escapement position RI, as shown in FIGS. 14 to 17.

At the escapement position R, the safety bar 310 is made integral with the roller 300 such as to cover the same and spaced apart together with the same a great distance from the printing cylinder 91.

Figure 21:
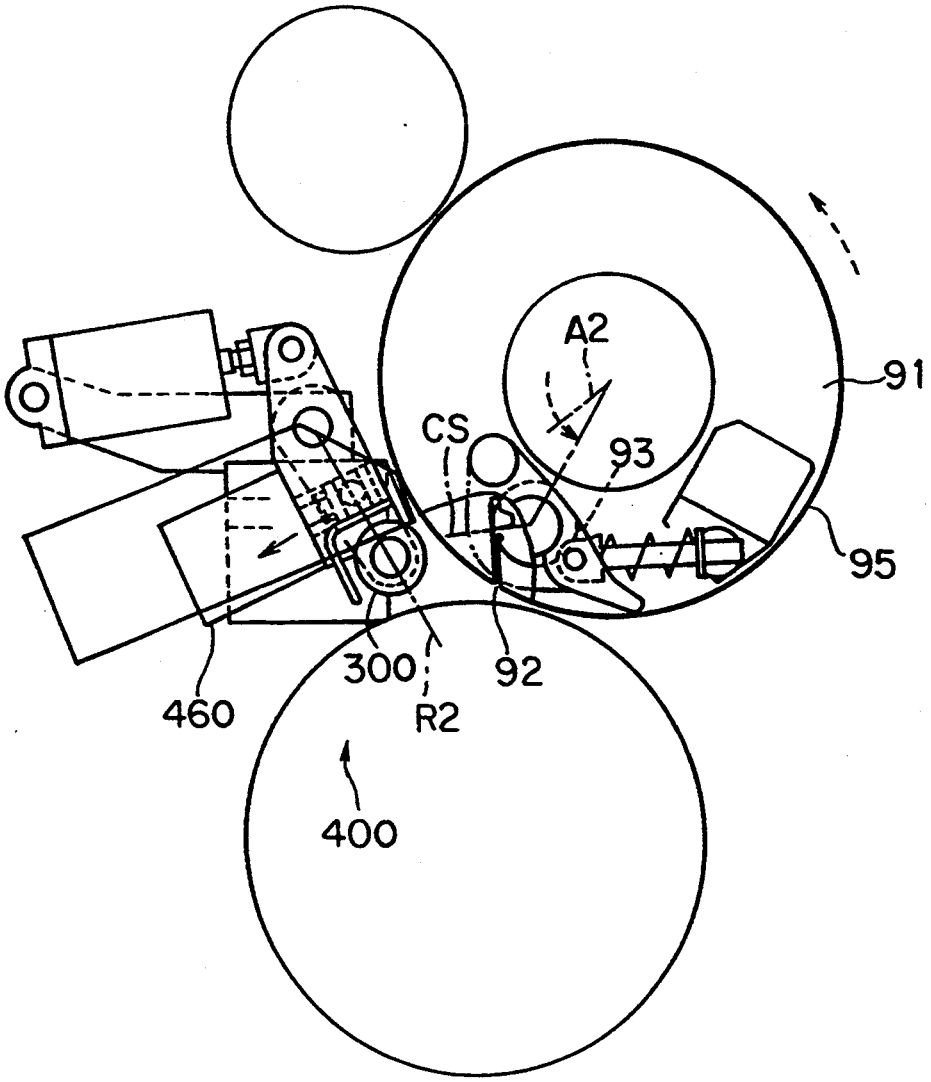

The roller drive means 400 is adapted such that when the escapement arm 430 is rotated to the side of the printing cylinder 91 with the urging arms 440 held spaced apart from the printing cylinder 91, the roller 300 is held at an approach position R2 slightly spaced apart from the periphery of the printing cylinder 91, as shown in FIGS. 13 and 21.

At the approach position R2, the safety bar 310 is in such a state as to cover the roller 300, while it is held together with the roller 300 at a position close to the printing cylinder 91.

Figure 19:
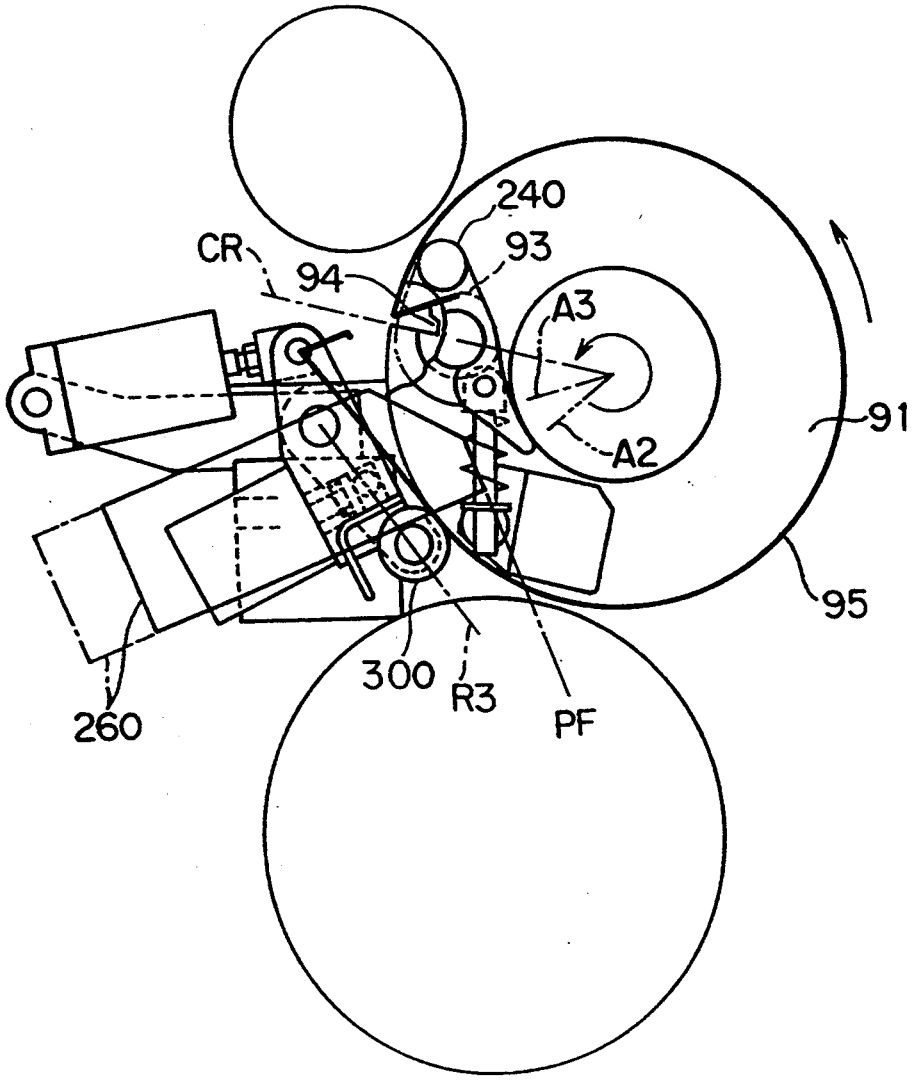

When the roller drive means 400 rotates both the escapement and urging arms 430 and 440 toward the printing cylinder 91, the roller 300 is caused to project from the safety bar 310 toward the printing cylinder 91 so that it can roll over the periphery of the printing cylinder 91 such that it is urged thereagainst. At this time, the roller 300 is at an urged position R3 as shown in FIGS. 18 to 20.

The urged position of the roller 300 corresponds to the opening of the cavity 92 with the printing cylinder 91 at the mounting position A2, as shown in FIG. 18.

Now, the method of replacing the printing plate with the apparatus having the above structure, will be described with reference to FIGS. 13 to 21.

For normal printing operation, a predetermined printing plate 95 is wound on the printing cylinder 91, and its ends are locked by the lock shaft 93 at the lock position CS, as shown in FIG. 13.

Then, the air cylinder 220 is retreated to bring the contact member 260 to the rearward position PR for avoiding interference of the member with the de-mounting and mounting levers 230 and 240.

Further, the escapement and approach cylinders 450 and 460 are retreated to bring the roller drive means 400 to the approach position R2, thus holding the roller 300 out of contact with the printing plate 95 mounted on the printing cylinder 91 and also holding the safety bar 310 at rolling contact portions of the printing cylinder 91 and blanket cylinder 140.

In this state, the printing cylinder 91 and blanket cylinder 140 are rotated for normal printing operation.

The printing plate 95 is replaced in the following operation.

First, the printing cylinder 91 is stopped at the de-mounting position A1, as shown in FIG. 14. The de-mounting lever 230 of the lock shaft 93 at the lock position CS is caused to face the end of the contact member 260, and the escapement cylinder 450 is advanced to bring the roller drive means 400 to the escapement position RI and bring the roller 30 a position greatly spaced apart from the printing cylinder 91.

Then, as shown in FIG. 15, the air cylinder 220 is advanced to cause advancement of the contact member 260 from the rearward position PR to the forward position PF. The de-mounting lever 230 is thus driven by the end of the contact member 260, and the contact member 260 is returned to the rearward position PR. Thus, the lock shaft 93 is rotated to the unlock position CR to release the lock of the ends of the printing plate 95. The trailing plate end is then taken out from the slit 94.

In this state, the printing cylinder 91 is rotated reversely, as shown in FIG. 16, while gradually pulling the printing plate 91 from the released trailing end thereof away from the periphery of the printing cylinder 95. Then, the printing cylinder 95 is reversely rotated substantially by one rotation and stopped at the mounting position A2. Finally, the leading end of the printing plate 95 remaining in the cavity 92 is taken out.

Subsequently, the leading end of a new printing plate 95 is introduced into the printing cylinder 91, as shown in FIG. 17. The leading plate end (i.e., head) has been folded in advance, and it is inserted and engaged in the cavity 92.

Then, as shown in FIG. 18, the escapement cylinder 450 is retreated while advancing the approach cylinder 460 to bring the roller drive means 400 to the approach position R3. The roller is urged against the periphery of the printing cylinder 91 while clamping a portion of the new printing plate 95 near the leading end thereof engaged in the opening of the cavity 92.

In this state, the printing cylinder 91 is rotated forward as shown in FIG. 19 to cause rolling of the roller 300 over the periphery of the printing cylinder 91 while clamping the new printing plate 95.

In this way, the printing plate 95 is progressively urged against the periphery of the printing cylinder 91 by the roller 300 is thus is gradually wound on the printing cylinder 91.

By the time when the printing cylinder 91 rotated forward reaches the clamping start position A3, the trailing end (or tail) of the printing plate 95, having been folded in advance, is automatically inserted into the slit 94 of the lock shaft 93.

Prior to the reaching of the clamping start position A3 by the printing cylinder 91, the contact member 260 is advanced to the forward position, while the speed of rotation of the printing cylinder 91 is slowed down to a low speed forward rotation state.

When the printing cylinder 91 reaches the clamping start position A3, the mounting lever 240 comes to be slidably guided by the cam portion 270 of the contact member 260. The lock shaft 93 is thus gradually rotated toward the lock position CS, thus taking in the trailing end of the printing plate 95 into the cavity 92.

Subsequently, when the printing cylinder 91 is rotated by one rotation and passes by the mounting position A2, the lock shaft 93 is held at the lock position CS, as shown in FIG. 21. Thus, the printing plate 95 is mounted on the periphery of the printing cylinder 91 with its opposite ends taken in and clamped with a predetermined clamping force.

When the printing plate 95 has been mounted in this way, the contact member 260 is brought to the rearward position PR, and the approach cylinder 460 is retreated to bring the roller drive means to the approach position R2 and separate the roller 300 from the printing plate 95 on the printing cylinder 91.

Now, the printing cylinder 91 is rotatable for printing with the newly mounted printing plate 95.

With the above embodiment, the following effects can be obtained.

The lock shaft 93 can be rotated to the lock and unlock positions CS and CR by the lock shaft drive means 903, thus permitting automatic locking and unlocking of the ends of the printing plate 95 wound on the periphery of the printing cylinder 91.

Particularly, the lock shaft drive means 903 causes rotation of the lock shaft 93 by causing the advancement or retreat of the contact member 260 with the air cylinder 220 and thus causing the end of the contact member to push the de-mounting or mounting lever 230 or 240. It is thus possible to obtain coupling and de-coupling with respect to the printing cylinder 91 at the same time, thus permitting smooth operation.

Further, with this embodiment the can portion 270 of the contact member 260 has an effect of slowing down the printing cylinder 91 while the mounting lever 240 is guided to move the lock shaft 93 to the lock position CS. Thus, there is no need of stopping the printing cylinder for clamping the printing plate 95, thus permitting easy control and smooth and quick operation.

Further, with this embodiment the removal of the printing plate 95 from the printing cylinder 91 is effected by rotating the printing cylinder 91 reversely, while the winding of the printing plate 95 on the printing cylinder 91 is effected by rotating the printing cylinder 91 forward. Particularly, when winding the printing plate 95, the plate is urged progressively against the periphery of the printing cylinder 91 by the roller 300. Thus, it is only the hooking of the end of the printing plate 95 that requires manual operation, thus greatly improving the factor of automation of the operation of replacing the printing plate 95.

Further, the roller drive means 400 can separate the roller 300 from the urged position R3 in forced contact with the printing cylinder 91 to the escapement position R1 to provide for a sufficient operation space in front of the cavity 92 of the printing cylinder 91. It is thus possible to readily carry out the manual operation of hooking and engaging the end of the printing plate 95.

Particularly, with this embodiment the roller 300 is provided such that it is integral with the safety bar 310, which can be separated from the printing cylinder 91 by the roller drive means 400. Thus, it is possible to reliably ensure the operation space noted above. In addition, the structure can be reduced in size and simplified.

Furthermore, the roller drive means 400 is stopped at the approach position R2, at which the safety bar 310 should be. Thus, it is possible to ensure the fundamental protective function during operation. In this connection, the roller drive means 400 effects switching between the escapement and approach positions R1 and R2 with the escapement cylinder 450 and effects switching between the approach and urged positions R2 and R3 with the approach cylinder 460, thus permitting ready control and setting adjustment.

Further, since the normal approach position R2 can be provided even with the cylinders 450 and 460 in the retreated state, it is possible to ensure the safety during the printing operation even in the event of a trouble.

Moreover, with this embodiment the roller drive means 400, air cylinder 220 of the lock shaft drive means 903, etc. are collectively provided in the gap 150 with respect to the printing cylinder 91, thus avoiding the size increase of the apparatus, avoiding interference with other mechanisms and readily permitting installation of the apparatus in well-known printing presses.

The above embodiments of the invention are by no means limitative; for instance, the invention may cover the following modifications.

The cylinders 21, 31, 51 and 220 used as the printing plate drive means and the escapement and urging cylinders 400 and 460 used as the roller drive means 400 may be of oil hydraulic type as well as pneumatic type. Further, it is possible to use electromagnetic drive means such as solenoids or combinations of motors and rack-and-pinion type gear mechanisms. In general, any mechanism may be used so long as it permits the intended driving.

Figure 22:
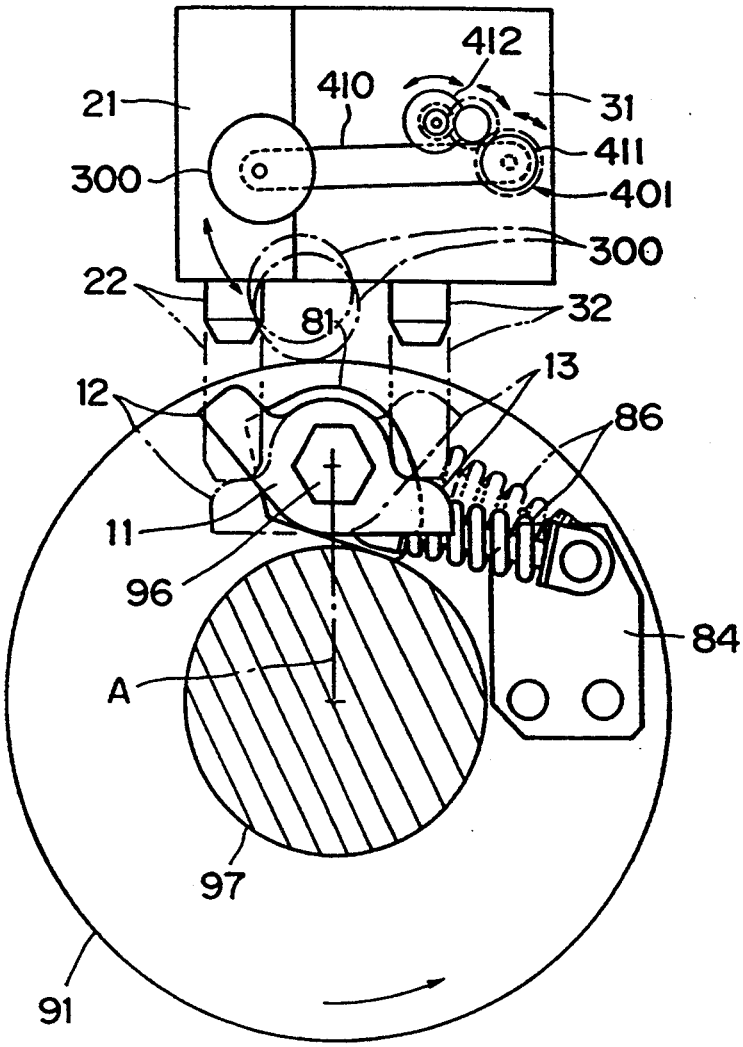
FIGS. 22 and 23 are transversal sectional views showing a modification of the printing plate replacement apparatus according to the invention.

As an example, FIG. 22 shows a printing plate replacement apparatus, which comprises the printing plate mounting apparatus shown in FIG. 2 and gear mechanism roller drive means 401. The roller drive means 401 includes an arm 410, which carries the roller 300 noted above provided at one of its ends and has the other end rotatably mounted on a frame (not shown), a gear 411 secured to the other end of the arm 410 such that it is concentric with the axis of rotation of the arm 410, and a servo motor 412 coupled to the gear 411. With forward and reverse rotation of the servo motor 412, the arm 410 is rocked to move the roller 300 to one of three positions, i.e., an urged position, an approach position and an escapement position.

Figure 23:
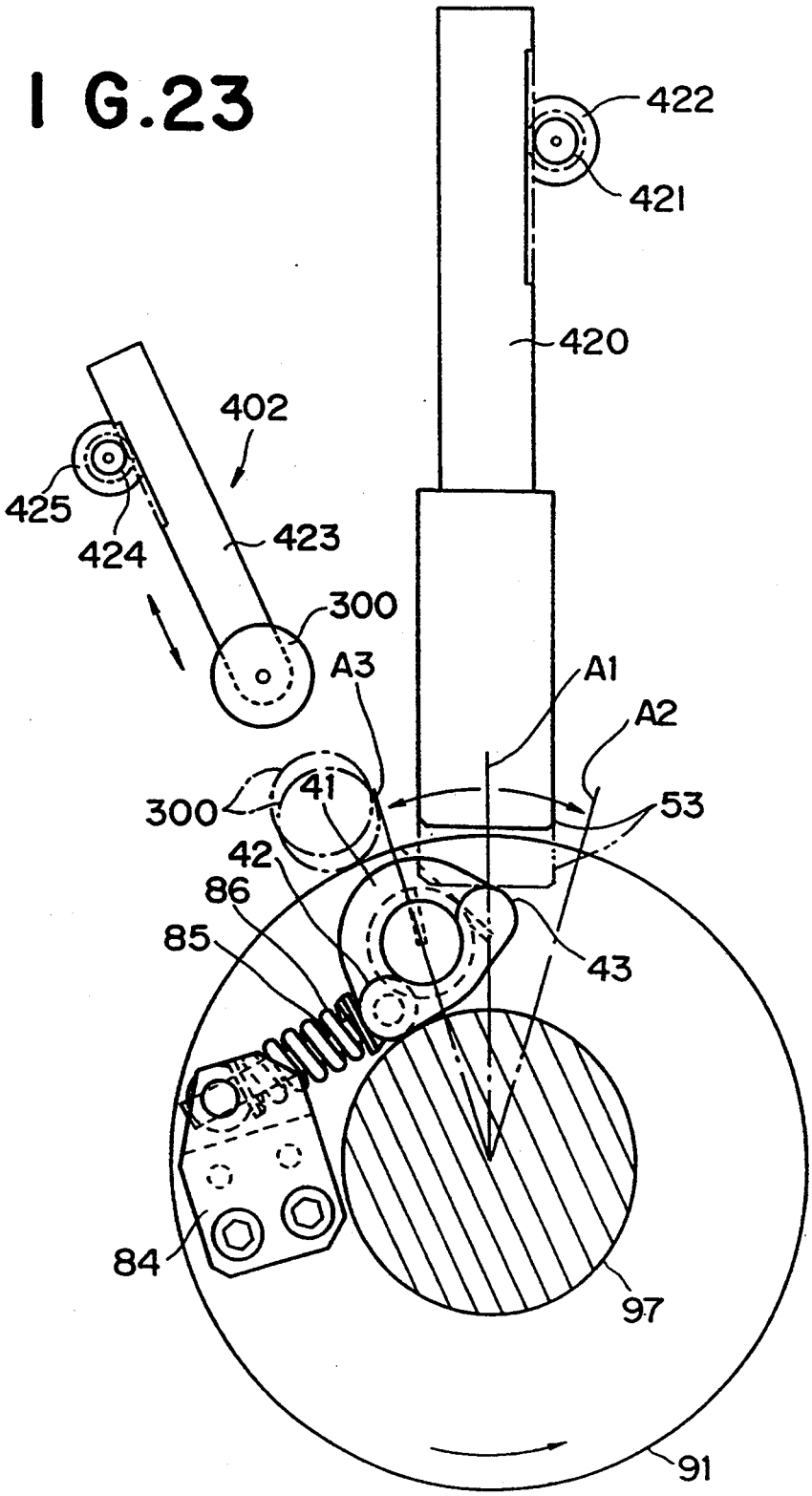

FIG. 23 shows a printing plate replacement apparatus, which uses a rack 420, a pinion 421 and a servo motor 422 in lieu of the air cylinder 51 and also uses a rack 423, a pinion 424 and a servo motor 425 as the roller drive means 402. With this printing plate replacement apparatus, it is also possible to obtain intended effects.

Further, the positioning control of the drive mechanism for rotating the printing cylinder 91 is not essential for stopping the printing cylinder 91 at the replacement position A1 or the de-mounting and mounting positions A2 and A3. For example, it is possible to utilize mechanical positioning means such as positioning pins. In practice, suitable means may be selected appropriately.

Further, the positioning control of the drive means for rotating the printing cylinder 91 is not essential for stopping the printing cylinder 91 at the de-mounting and mounting positions A2 and A3. For example, it is possible to utilize mechanical positioning means such as positioning pins. In practice, suitable means may be selected appropriately.

As has been described in the foregoing, with the printing plate mounting apparatus according to the invention the rotational driving of the lock shaft and the coupling and de-coupling of the driving may be effected collectively with the advancement and retreat of the contact member of the drive means. It is thus possible to simplify and reduce size of the structure and also simplify and enhance the stability of the operation. Further, with the printing plate mounting apparatus and printing plate mounting method according to the invention, the printing plate ends can be locked by the printing plate mounting mechanism and lock shaft drive means, and also the printing plate can be wound on the printing cylinder with the roller and roller drive means by making use of the rotation of the printing cylinder. Thus, it is possible to permit the printing plate replacement operation efficiently and reliably and also automate the operation.

What is claimed

1. A printing plate replacement apparatus for replacing a printing plate mounted on a printing cylinder, comprising:

a lock shaft buried movably in said printing cylinder at a predetermined location near a periphery of said printing cylinder, said lock shaft serving to lock ends of said printing plate to be mounted on said printing cylinder when said lock shaft is in a predetermined lock position and to unlock said ends of said printing plate when said lock shaft is in predetermined unlock position;

lock shaft drive means for moving said lock shaft to said predetermined lock position while said printing cylinder is at a predetermined mounting position and for moving said lock shaft to said predetermined unlock position while said printing cylinder is at a predetermined de-mounting position;

a roller located near a surface of said printing cylinder; and roller drive means for moving said roller from an urged position, at which position said roller is located proximate to said printing cylinder, to a retreated position, at which position a predetermined gap is formed between said roller and said printing cylinder, said roller pushing said printing plate towards said surface of said printing cylinder when said roller is in said urged position during mounting of said printing plate on said printing cylinder.

2. A printing plate replacement apparatus according to claim 1, wherein said lock shaft drive means includes:

a mounting lever and a de-mounting lever, said mounting lever and said de-mounting lever being secured to an end of said lock shaft and projecting on opposite sides of said lock shaft in a circumferential direction of said printing cylinder; and printing cylinder replacement drive means for contacting said mounting lever to rotate said lock shaft in a locking direction when said printing cylinder is at said predetermined mounting position and for contacting said de-mounting lever to rotate said lock shaft in an unlocking direction when said printing cylinder is at said predetermined de-mounting position.

3. A printing plate replacement apparatus according to claim 2, wherein said predetermined mounting position and said predetermined de-mounting position are different, and said printing plate replacement drive means includes:

a contact member, which is capable of being advanced and retreated with respect to said printing cylinder and being brought into contact with said de-mounting lever to rotate said lock shaft to said unlock position when said printing cylinder is at said predetermined de-mounting position; and a cam member, which is formed on an end portion of said contact member and guides said mounting lever in a predetermined direction to rotate said lock shaft toward said lock position when said printing cylinder is rotated in a forward direction toward said mounting position.

4. A printing plate replacement apparatus according to claim 3, wherein said contact member is provided on a cylinder means.

5. A printing plate replacement apparatus according to claim 2, wherein said predetermined mounting position and said predetermined de-mounting position are identical, and said printing plate replacement drive means includes:

a plurality of cylinder means, each cylinder means having a contact member associated therewith, wherein each of said cylinder means is capable of advancing and retreating its associated contact member with respect to said printing cylinder, the contact member of one of said cylinder means being capable of being brought into contact with said mounting lever, said contact members of another one of said cylinder means being capable of being brought into contact with said de-mounting lever.

6. A printing plate replacement apparatus according to claim 5, wherein said mounting and de-mounting levers are fitted on an end of said lock shaft and retained by stoppers.

7. A printing plate replacement apparatus according to claim 4, wherein said mounting lever is capable of being brought into contact with said contact member when said printing cylinder is in said predetermined mounting position and said de-mounting lever is capable of being brought into contact with said contact member when said printing cylinder is in said predetermined de-mounting position.

8. A printing plate replacement apparatus according to claim 1, wherein said roller is provided in a safety bar disposed a first distance from rolling contact portions of said printing cylinder and a different cylinder, and said roller drive means moves said roller and said safety bar in unison with each other and is capable of being stopped at an approach position, which is between said retreated position said urged position, at which position said safety bar is disposed a second distance from said rolling contact portions.

9. A printing plate replacement apparatus according to claim 1, wherein said roller drive means includes an escapement cylinder and an approach cylinder, said escapement cylinder and said approach cylinder being coupled to said roller, said escapement cylinder causing said roller to advance and to retreat between an approach position and an escapement position, said approach cylinder causing said roller to advance and to retreat between said urged position and said approach position.

10. A printing plate replacement apparatus according to claim 1, wherein said roller drive means includes a gear mechanism for causing said roller to advance and to retreat with respect to three positions, wherein said three positions include said urged position, an escapement position, which is far from said urged position, and an approach position, which is between said urged and said escapement position.

11. A printing plate replacement method for replacing a printing plate having a leading edge and a trailing edge on a printing cylinder, said printing cylinder capable of being stopped at a predetermined de-mounting position for releasing said printing plate and a predetermined mounting position for receiving said printing plate, said printing cylinder having a movably buried lock shaft which locks ends of said printing plate to said printing cylinder, said method comprising the steps of:

stopping said printing cylinder carrying said printing plate mounted thereon at said predetermined de-mounting position;

moving said lock shaft to an unlock position for unlocking said ends of said printing plate from said printing cylinder;

removing said trailing end of said printing plate from said cylinder;

rotating said printing cylinder in an opposite direction to a forward direction corresponding that followed during normal printing operation for gradually separating said printing plate from a peripheral surface of said printing cylinder;

stopping said printing cylinder at said predetermined mounting position;

removing said leading end from said printing cylinder;

inserting said leading end of a new printing plate into said printing cylinder while said printing cylinder is held at said predetermined mounting position;

engaging said leading end of said printing plate with said printing cylinder in a vicinity of said lock shaft;

urging a portion of said printing plate near said leading end thereof against said peripheral surface of said printing cylinder with said roller;

rotating said printing cylinder in said forward direction to wind said printing plate thereon;

engaging said trailing end of said printing plate in said lock shaft;

moving said lock shaft to a lock position to lock said trailing end of said printing plate in said printing cylinder; and moving said roller to an escapement position, at which said roller is spaced apart a predetermined distance from said printing cylinder.

12. A printing plate replacement method according to claim 11, wherein said printing cylinder is rotated more slowly during said step of rotating said printing cylinder in said forward direction than when said printing cylinder is during said normal printing operation.

* * * * *